US009357886B2

(12) United States Patent
Duncan et al.

(10) Patent No.: US 9,357,886 B2
(45) Date of Patent: Jun. 7, 2016

(54) DISPENSER SHROUD

(71) Applicant: OP-Hygiene IP GmbH, Niederbipp (CH)

(72) Inventors: David Duncan, St. Catharines (CA); Heiner Ophardt, Arisdorf (CH)

(73) Assignee: OP-Hygiene IP GMBH, Niederbipp (CH)

( * ) Notice: Subject to any disclaimer, the term of this patent is extended or adjusted under 35 U.S.C. 154(b) by 0 days.

(21) Appl. No.: 14/446,875

(22) Filed: Jul. 30, 2014

(65) Prior Publication Data

US 2015/0034677 A1 Feb. 5, 2015

Related U.S. Application Data

(60) Provisional application No. 61/860,628, filed on Jul. 31, 2013.

(51) Int. Cl.

| | |
|---|---|
| ***B67D 7/06*** | (2010.01) |
| ***B65D 37/00*** | (2006.01) |
| ***A47K 5/12*** | (2006.01) |
| *A47K 5/122* | (2006.01) |
| *A47K 5/00* | (2006.01) |

(52) U.S. Cl.

CPC ..... *A47K 5/1211* (2013.01); *A47K 5/12* (2013.01); *A47K 5/00* (2013.01); *A47K 5/122* (2013.01)

(58) Field of Classification Search

CPC ..... A47K 5/00; A47K 5/1211; A47K 5/12; A47K 5/122

See application file for complete search history.

(56) References Cited

U.S. PATENT DOCUMENTS

| | | | | |
|---|---|---|---|---|
| 3,592,245 | A * | 7/1971 | Schneller et al. | 141/25 |
| 5,248,066 | A | 9/1993 | Olson et al. | |
| 5,549,120 | A * | 8/1996 | Persson et al. | 128/842 |
| 5,697,525 | A | 12/1997 | O'Reilly et al. | |
| 5,803,315 | A * | 9/1998 | Kaufman | 222/183 |
| 5,954,238 | A * | 9/1999 | Rausch | 222/158 |
| 5,984,146 | A * | 11/1999 | Kaufman | 222/190 |
| 6,131,773 | A | 10/2000 | Wade et al. | |
| 6,308,863 | B1 * | 10/2001 | Harman | 222/135 |
| 6,325,245 | B1 | 12/2001 | Matthews | |
| 6,454,135 | B1 * | 9/2002 | Brozell | 222/135 |
| 8,459,508 | B2 * | 6/2013 | Westphal | 222/183 |
| 2012/0111891 | A1 | 5/2012 | McNulty et al. | |

FOREIGN PATENT DOCUMENTS

| | | |
|---|---|---|
| WO | 9830492 | 7/1998 |
| WO | 9832691 | 7/1998 |
| WO | 2004018301 | 3/2004 |
| WO | 2007084733 | 7/2007 |

* cited by examiner

*Primary Examiner* — Frederick C Nicolas

(74) *Attorney, Agent, or Firm* — Thorpe North & Western, LLP

(57) ABSTRACT

A shroud cover for a dispenser is a flexible sheet disposed about an open framework. Preferably, the flexible sheet is resiliently stretchable and stretched over the framework.

32 Claims, 22 Drawing Sheets

DISPENSER SHROUD

PRIORITY CLAIM

Priority is claimed to U.S. Provisional Patent Application Ser. No. 61/860,628 filed Jul. 31, 2013, which is hereby incorporated herein by reference in its entirety.

SCOPE OF THE INVENTION

This invention relates to shrouds and covers for dispensers and, more particularly, to a cover shroud for a dispenser having a deferrable flexible portion of sheet material preferably formed from a stretchable fabric.

BACKGROUND OF THE INVENTION

Fluid dispensers are known as for dispensing a band cleaning fluid onto the hand of a user. Many typical hand soap dispensers include a reservoir or container containing the fluid to be dispensed, a pump mechanism to dispense fluid from the reservoir and an activation mechanism to operate the pump. With many hand cleaning dispensers, a rigid plastic cover which is mounted to the dispenser in a manner to cover and enclose the reservoir and often other internal components of the dispenser such as the pump mechanism. The cover is often coupled to a housing for the dispenser for movement between open and closed positions to access the reservoir as for refilling or removal and replacement by another reservoir.

The present applicant has appreciated a number of disadvantages with known rigid covers for a fluid dispenser. One disadvantage is that the rigid cover encloses a fixed volume and thus there is a maximum size to a reservoir which may be enclosed within the cover. Such rigid covers suffer the disadvantage that they do not have the capability of accommodating reservoirs with a volume larger than the internal volume of the rigid cover.

The rigid plastic covers occupy a volume when not in use as, for example, when shipped or stored. Rigid covers suffer the disadvantage that they cannot be collapsed or reduced in volume for ease of shipment or storage.

Known rigid covers suffer the disadvantage that they are relatively expensive and comprise a relatively substantial amount of plastic material.

Known rigid covers have the disadvantage that indicia or other graphics which may be applied to the cover are difficult to remove or replace and, as well, are relatively difficult to customize other than on a mass basis.

SUMMARY OF THE INVENTION

To at least partially overcome these disadvantages of previously known devices, the present invention provides a shroud cover for a dispenser comprising in a first aspect a flexible sheet disposed about an open framework. Preferably, the flexible sheet is resiliency stretchable and stretched over the framework.

In a first aspect, the present invention provides a fluid dispenser comprising:

with a reservoir for fluid, a cover shroud at least partially enclosing the reservoir, the shroud having a resiliently deformable portion having an inherent bias to assume an unbiased condition in which the shroud enclosed a first volume, the deformable portion being deformable from the unbiased condition to a biased condition in which the shroud encloses a second volume different than the first volume.

Preferably, the second volume is greater than the first volume. Preferably, the deformable portion comprises an elastomeric material. Preferably, the elastomeric material is a stretchable fabric. Preferably, the dispenser includes a window through the shroud having a window perimeter with the deformable portion comprising a sheet member spanning across the window from the perimeter in the unbiased condition and the biased condition. Preferably, the reservoir includes a protuberant portion which extends from within the shroud through the window and deforms the deformable portion outwardly through the window from the unbiased condition to the biased condition. Preferably, the reservoir is collapsible and collapses from an initial enlarged configuration of an initial volume to a collapsed condition of a collapsed volume less than the initial volume, and when the reservoir is in the enlarged configuration, the reservoir includes a protuberant portion winch extends from within the shroud through the window and deforms the deformable portion outwardly through the window from the unbiased condition to the biased condition, wherein with the collapse of the reservoir as fluid is dispensed from the reservoir, the protuberant portion withdraws through the window to within the shroud and the deformable portion deforms from the biased condition to the unbiased condition. Preferably, the dispenser includes a protuberant portion which extends from within the shroud through the window and deforms the deformable portion outwardly through the window from the unbiased condition to the biased condition. Preferably, the protuberant portion is mounted to the dispenser for movement between an extended position and a retracted position, and in the extended position, the protuberant portion extends from within the shroud through the window and deforms the deformable portion outwardly through the window from the unbiased condition to the biased condition, in the retracted position the protuberant portion does not extend from within the shroud through the window, and in movement from the extended position to the retracted position, the protuberant portion withdraws through the window to within the shroud and the deformable portion deforms from the biased condition to the unbiased condition. Preferably, movement of the protuberant portion between the extended position and the retracted position is controlled as a function of the operation of the dispenser in dispensing fluid. Preferably, the dispenser includes an actuator which moves to dispense fluid from the reservoir, wherein on moving the actuator to dispense fluid moves the protuberant portion between the extended position and the retracted position. In one arrangement, the dispenser is a manually operated dispenser which includes an actuator movable by a user to dispense fluid from the reservoir, and in which on moving the actuator to dispense fluid moves the protuberant portion between the extended position and the retracted position.

In a second aspect, the present invention provides a shroud for a fluid dispenser comprising a resiliency stretchable sheet stretched over a framework having at least one window which is spanned by the sheet. Preferably, the sheet closes the window. Preferably, the sheet is deformable to stretch outwardly in the window if a protuberant member is moved from within the shroud outwardly through the window. Preferably, the window has a perimeters the sheet is in engagement with the entire perimeter of the window and closes the window. Preferably, the sheet has an inherent bias to assume an unbiased condition, with the sheet being deformable from the unbiased condition to a first biased condition in which the sheet spans the window, and if a protuberant member is moved from within the shroud outwardly through the window, the sheet being deformable from the first biased condition away from the unbiased condition to a second unbiased in which the sheet spans the window and accommodates the deflection by the protuberant member.

In a third aspect, the present invention provides a shroud for a fluid dispenser comprising:

a hollow tube of flexible sheet material extending along a central axis from a first end to a second end, the tube having a first internal circumferential extent at the first end and a second internal circumferential extent at the second end, a framework including a first frame end and a second frame end spaced from the first frame end, the first frame end having an external circumferential extent at least as large as the first internal circumferential extent of the tube, the second frame end having an external circumferential extent at least as large as the second internal circumferential extent of the tube, the tube disposed over the framework with the first end of the tube received about the first end frame and the second end of the tube received about the second end frame. Preferably, the tube is tensioned axially between the first frame end and the second frame end enclosing an open interior cavity therein. Preferably, the distance between the first frame end and the second frame end is variable as measured along the axis to vary the volume of the open interior cavity therein. Preferably, the shroud includes a locking mechanism to releasably fix the distance between the first frame end and the second frame end at one of a first length and a second length. Preferably, the first internal circumferential extent is equal to the second internal circumferential extent with the tube having a constant internal circumferential extent throughout its length. Preferably, the first internal circumferential extent is equal to the first external circumferential extent and the second internal circumferential extent is equal to the second external circumferential extent. In one arrangement the sheet material is substantially not stretchable, however, a stretchable material may be used. Preferably, the shroud is utilized in a dispenser including a fluid reservoir within the interior cavity. Preferably, the reservoir is collapsible as fluid is dispensed therefrom.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
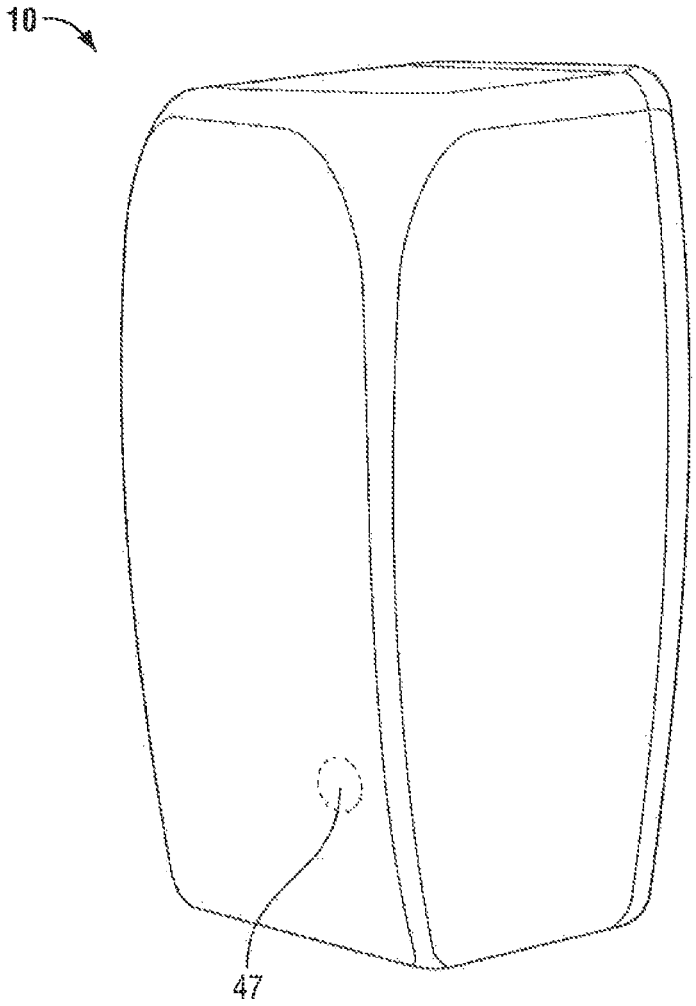
FIG. 1 is a perspective view of a soap dispenser in accordance with a preferred first embodiment of the present invention.
Figure 2:
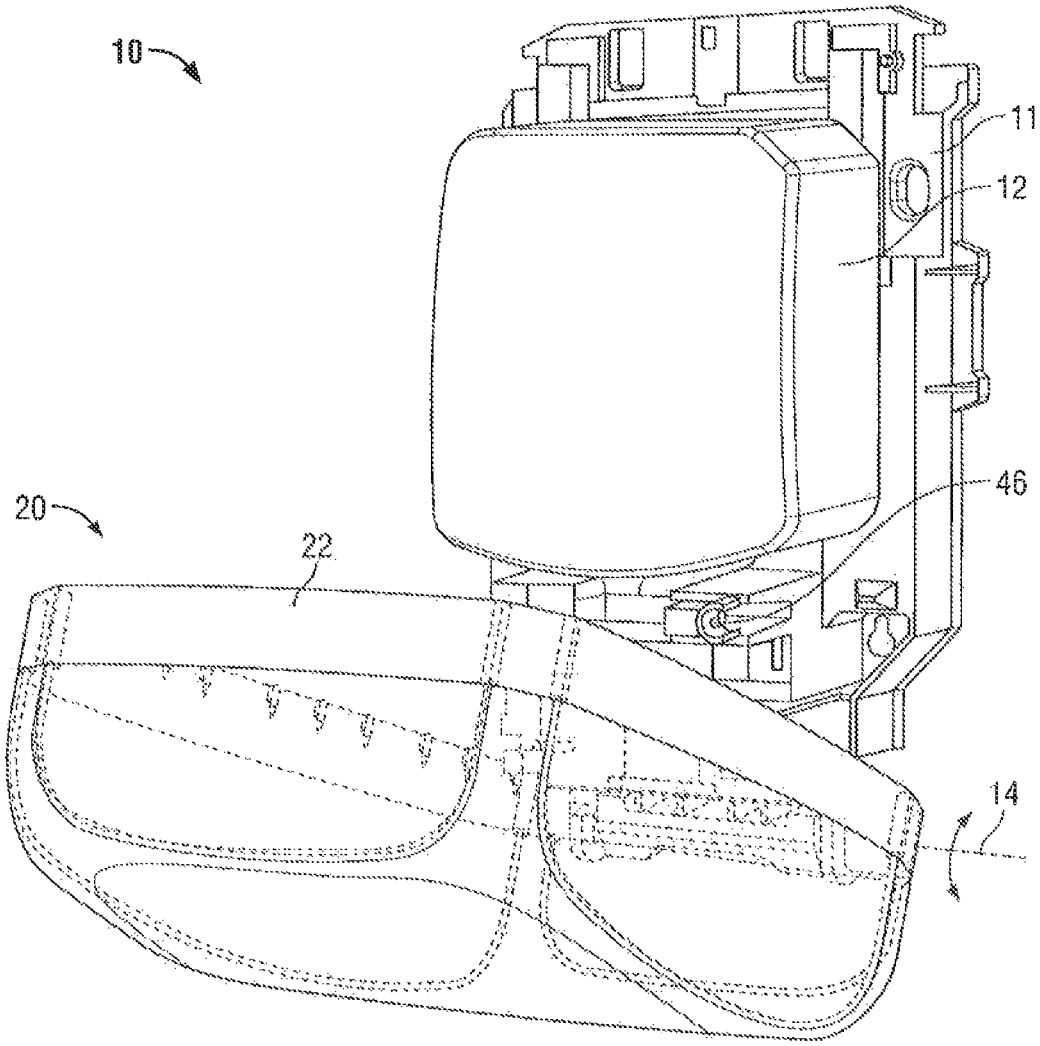
FIG. 2 is a schematic pictorial view of the dispenser of FIG. 1 with a first undersized reservoir and with the shroud in an open position.

Reference is made to FIGS. 1 to 9 which illustrate a dispenser 10 in accordance with a first embodiment of the present invention. As can be seen in FIG. 2, the dispenser includes a housing 11 adapted to mount the dispenser as, for example, to a wall. The housing carries various components including a reservoir 12 to contain fluid to be dispensed, a pump 13 schematically illustrated in FIG. 3 as being below the reservoir 12 and adapted to dispense from the reservoir 12 out an outlet tube 14 from the lower end of the dispenser and an activation mechanism 15 which is to activate the pump 13 to dispense fluid from the reservoir. In the preferred embodiment of FIGS. 1 to 3, sensors 16 are located directed downwardly from the housing and sense a person's hand underneath the outlet tube at which time the activation mechanism 15 activates the pump 13 to dispense fluid in a manner as is known with touchless fluid dispensers.

The dispenser includes a shroud 20 pivotally mounted to the lower end of the housing 11 for pivoting about a horizontal axis 14 between a closed position as seen in FIG. 1 to an open position as seen in FIG. 2.

Figure 5:
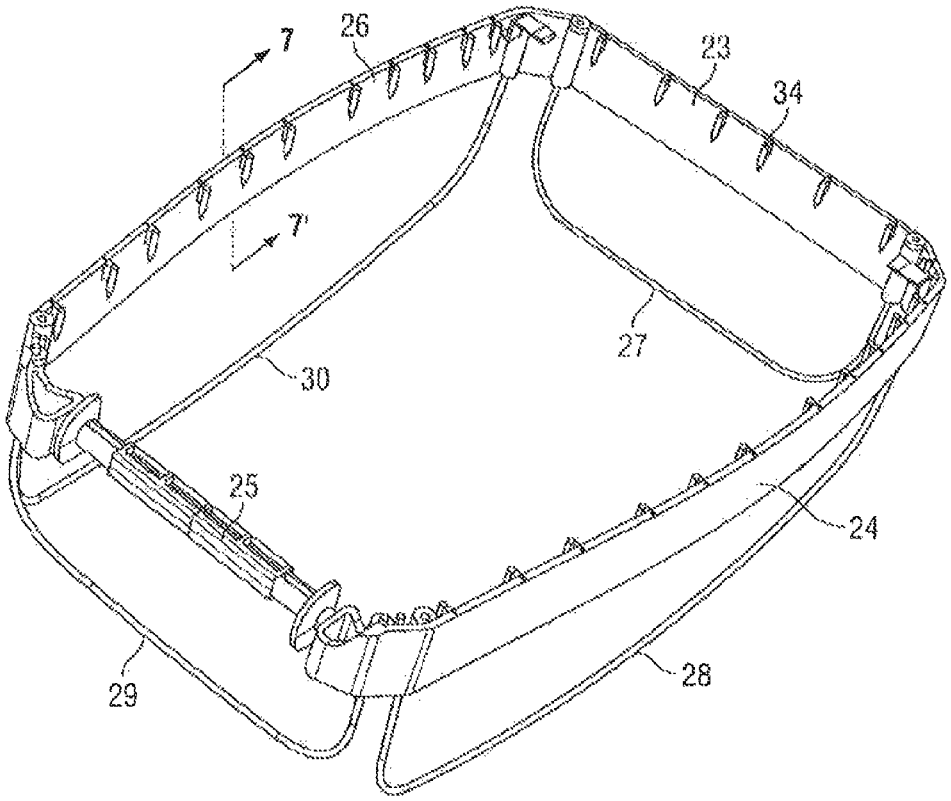
FIG. 5 is a bottom rear view of the shroud frame of FIG. 4 with its cover sheet removed.
Figure 6:
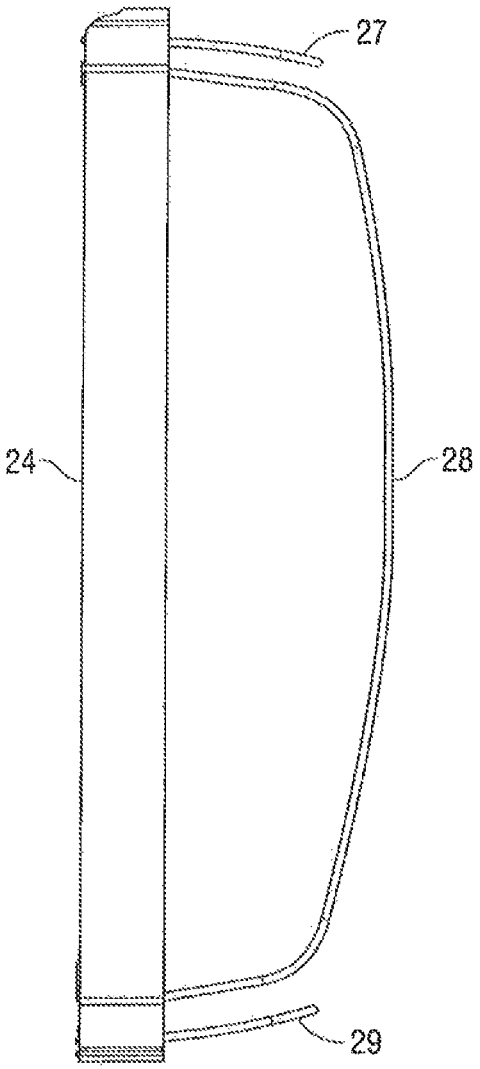
FIG. 6 is a side view of the shroud cover of FIG. 4 with the cover sheet removed.

The shroud 20 includes a shroud frame 21 over which a shroud cover sheet 22 is stretched. The shroud frame 21 includes, as seen in FIG. 5, a generally rectangular peripheral rear frame member 90 including a top frame member 23, a left side frame member 24, a bottom frame member 25 and a right side frame member 26 which are preferably formed from rigid plastic. The bottom frame 25 is formed to include an axle member 91 which permits snap-fit coupling to suitable journaling slots carried on the lower rear of the housing 11 by which the shroud 20 may be pivoted between the open and closed positions. The shroud frame also includes a top wire frame 27, a left side wire frame 28, a bottom wire frame 29 and a right side wire frame 30. The top frame 23 includes two blind front to rear extending line bores 31 and 32 open forwardly and adapted to securely engage therein a respective distal end of the top wire frame 27. The top wire frame 27 is preferably made of metal and is a rigid piece of metal which retains its loop shape so as to serve to extend the shroud frame 21 forwardly. Each of the other wire frames 28, 29 and 30 are similarly coupled to their respective frame member. The resultant shroud frame 21 thus has a three-dimensional shape with a front window 32 formed in between the forwardmost portions of the wire frames 27, 28, 29 and 30.

Figure 7:
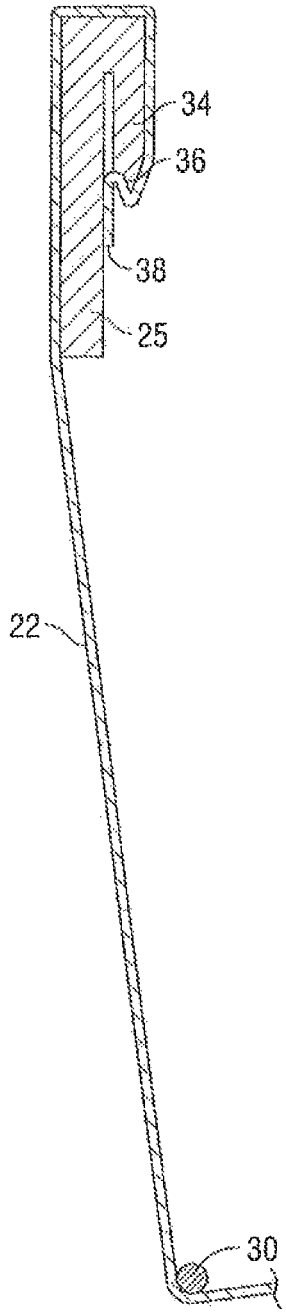
FIG. 7 is a schematic cross-sectional view of the shroud cover of FIG. 5 along section line 7-7' but showing the coupling of the cover sheet to the shroud frame.

The shroud cover sheet 22 is formed from a flexible sheet material which is flexible in two directions and elastically deformable. The cover sheet 22 is effectively formed as an open sock-like member which is adapted to be stretched over the front of the shroud frame 21 and to have peripheral edge portions of the sock extend rearwardly of the top frame 23, left side frame 24 and right side frame 26 to become engaged upon hook members 34 provided on the inside surface of each of these frame members 23, 24 and 26. FIG. 7 schematically illustrates in cross-section along section line 7-7' in FIG. 5 a cover sheet 22 as extending about the outside of the right side frame 26 about the rear of the right side frame 26 and then within the interior of the shroud frame 21 up the inside to be engaged over a forwardly directed projection 36 of the hook member 34. In application of the cover sheet 22 to the shroud frame 21, the cover sheet 22 is stretched over the frame members and when tensioned, a portion of the cover sheet 22 proximate its peripheral edge 38 is engaged on the hook members 34. The cover sheet 22 is a flexible sheet which when stretched, is biased to return to an unstretched form. The inherent bias of the cover sheet 22 draws the edge portions of the cover sheet into the hook members 34 so as to engage the cover sheet 22 on the shroud frame 21 against removal and to stretch the cover sheet 22 over the frame spanning the window 32 and the various other openings between the wire frame members and the edge frame members so as to provide an appearance as seen in FIG. 1.

Figure 8:
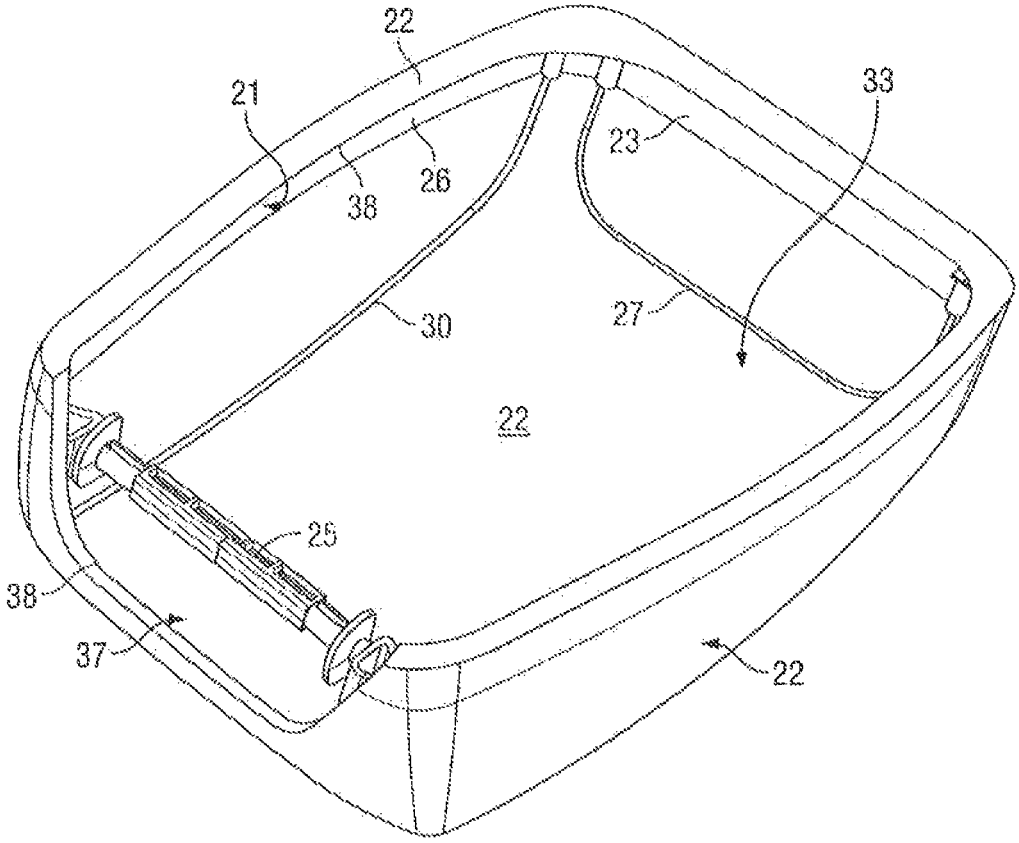
FIG. 8 is a bottom rear view of the shroud similar to FIG. 5 but showing the shroud cover applied.

Reference is made to FIG. 8 which is the same view as in FIG. 5, however, with the shroud cover 22 applied to the shroud frame 21. As can be seen, the cover sheet 22 has a peripheral edge 38 which forms an opening which is adapted to be stretched about the frame. The peripheral edge 38 is configured and formed such that when the cover sheet 22 is stretched over the shroud frame 21, located thereon to be tensioned, the peripheral edge 38 is disposed forwardly iron; the bottom frame 25 intermediate the bottom frame 25 and the bottom wire frame 29 such that a discharge opening 37 is provided through which fluid may be dispensed via the outlet tube 14 shown in FIG. 3 and, to the extern necessary, the sensor 16 which may, for example, comprise infrared emitters and sensors may sense a user's hand.

Figure 3:
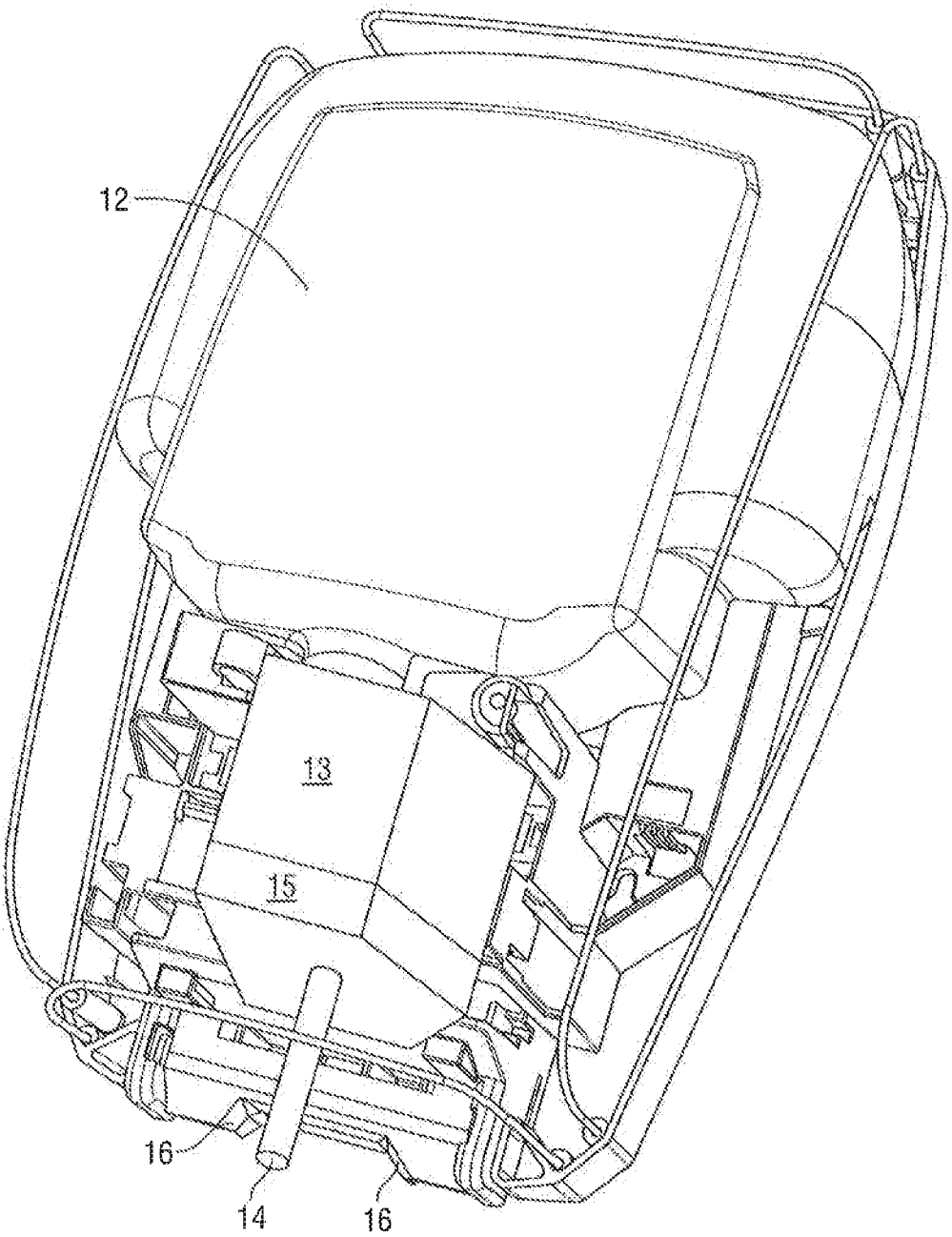
FIG. 3 is a schematic pictorial view of the soap dispenser of FIG. 1 with the shroud in the closed position but with its shroud cover sheet removed to show the shroud frame and some internal components.

The shroud 20, as seen in FIG. 8 with the cover sheet 22 merely stretched about the shroud frame 21, defines an internal cavity 33 of a notional first volume. As seen in FIGS. 1 to 3, the reservoir 12 is a undersized reservoir in the sense that the reservoir 12 is when the shroud 20 is in a closed position as shown in FIG. 1, received entirely within the cavity 33 formed by the shroud without the reservoir 12 contacting the shroud cover 22.

Figure 9:
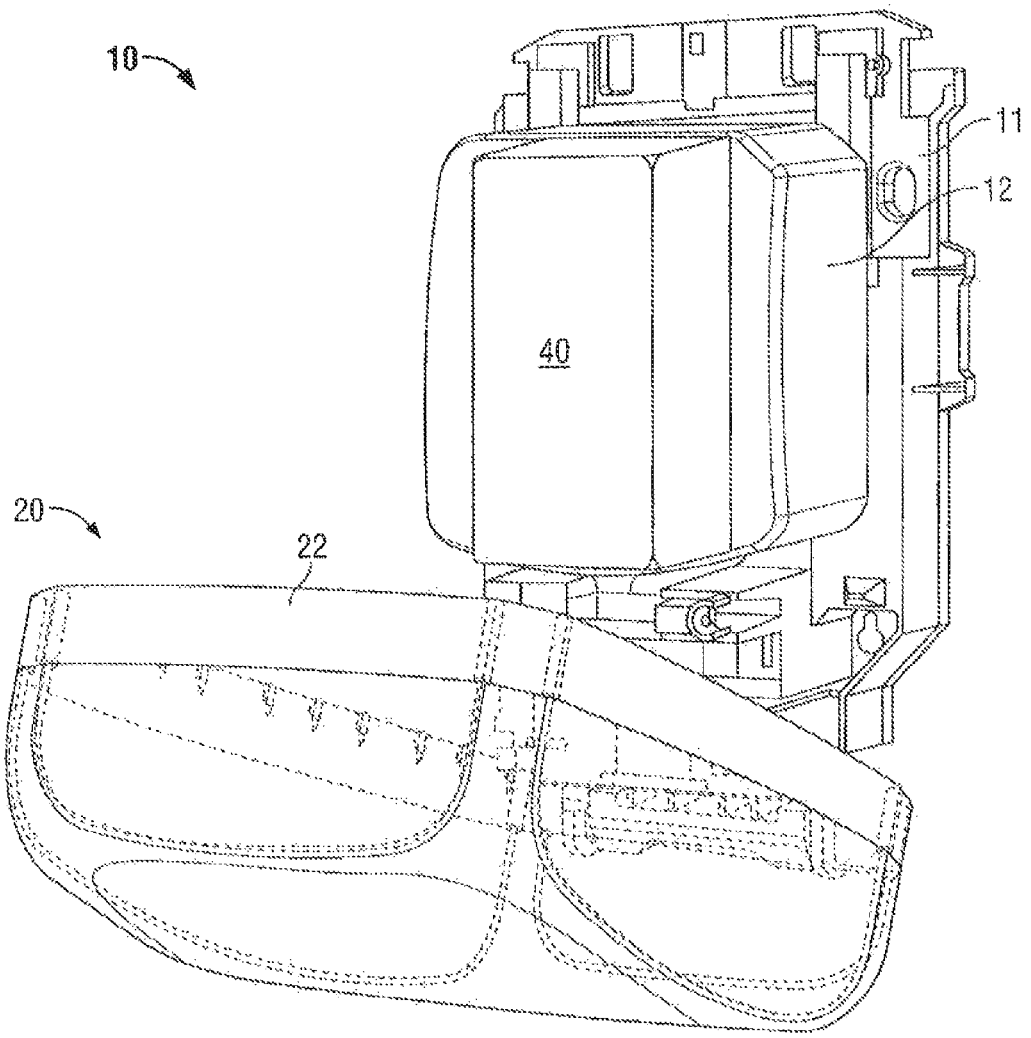
FIG. 9 is a schematic pictorial view of the dispenser of FIG. 2 with the shroud in an open position, however, with an oversized reservoir engaged in the housing.
Figure 10:
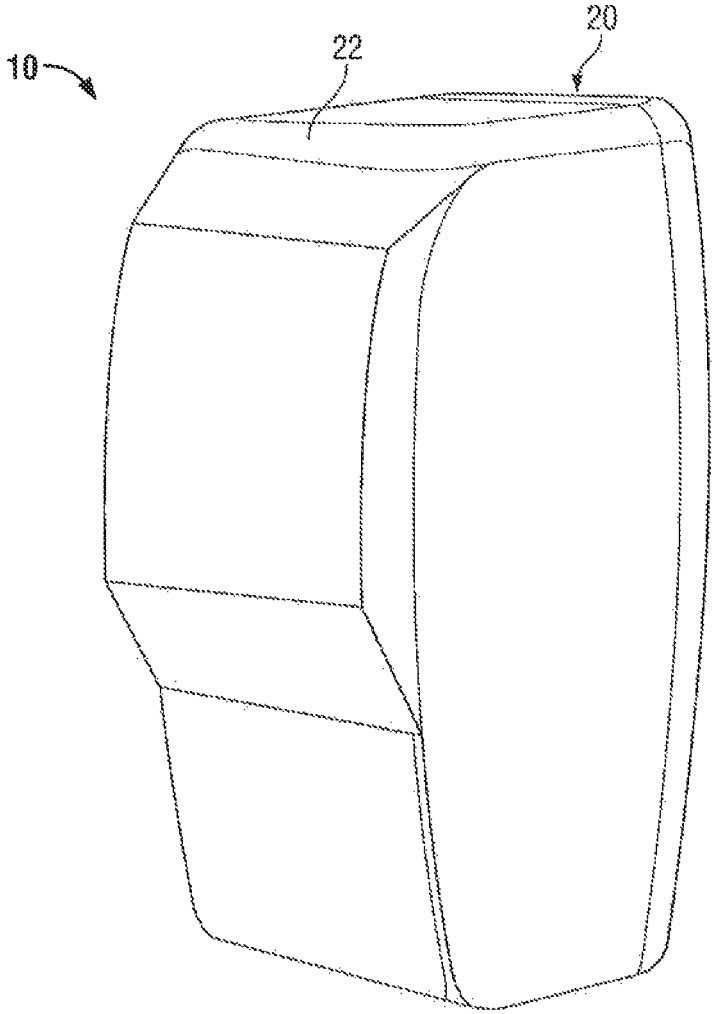
FIG. 10 is a perspective view of the dispenser of FIG. 9 with the shroud in the closed position and the protuberant portion of the oversized reservoir extending forwardly between the framework of the shroud and deforming the shroud sheet forwardly.

Reference is made to FIGS. 9 and 10 which are the same as FIGS. 2 and 1, respectively, however, in which an oversized reservoir 12 is provided identical to reservoir 12 of FIG. 2 but including a forwardly extending protuberant portion 40 which increases the volume of fluid that the reservoir 12 can hold. As seen in FIG. 10, when the shroud 20 is in the closed position, the protuberant portion of the reservoir extends from within the shroud cavity through the window 32 and deforms the cover sheet 22 outwardly through the window 32. In a comparison of FIG. 1 and FIG. 10, the oversized reservoir and its protuberant portion are accommodated by the dispenser merely by the resilient deformation of the shroud sheet 22 with the shroud 20 in a closed position. As shown in FIG. 10, the internal cavity defined within the deformed shroud sheet is of a second volume which is an increased volume compared to the volume of the cavity within the shroud cover as seen in FIG. 1.

The fluid dispenser in accordance with the present invention provides an advantageous arrangement in which a dispenser may be provided to receive reservoirs of different volumes and dimensions with oversized reservoirs being accommodated by resilient stretching of the elastic sheet material of the cover sheet 22. Thus, the dispenser as shown in FIG. 1 may be provided adapted to receive reservoirs which are undersized in the sense that they are received within the confines of the shroud frame and with the shroud frame, for example, extending a certain distance, for example, two to four inches from the rear of the housing. However, as seen in FIG. 10, oversized reservoirs may be provided which may, for example, have an increased width from a wall, for example, to increase the width of the dispenser from, for example, two or three inches to four or six inches by example.

The cover sheet 22 is preferably formed from a flexible material such as a flexible fabric such, for example, as a cloth of elastomeric material such as formed from the Spandex™ material. The cover sheet 22 may be suitably formed as an open ended sock of desired relative proportions such that when it is stretched over the shroud frame 21, the material will be tensioned across the various openings between the members of the frame to provide a pleasing external appearance. The relative configuration of the frame members and notably the wire frame members can be easily modified so as to provide different appearances to the resultant shroud 20 is stretched over the frame members.

Preferably, each of the wire frame members 27, 28, 29 and 30 are removably received within their respective bores 30 and 31. For shipment and storage, components of the shroud may be shipped, as a kit with the wire frames 27, 28, 29 and 30 and the cover sheet 22 received within the three-dimensional confines of the shroud frame 21, such that the kit comprising the components of the shroud 20 may be stored and shipped in a relatively smaller volume container than if the shroud frame 21 is assembled.

Referring to FIG. 2, schematically illustrated as 46 is an LED signal light which can be controlled by a controller for the dispenser to signal to a user various states of operation. For example, the light may flash on and off, may stay on and may display different or varying colours. Preferably, in accordance with the present invention, the light emitted by the LED is projected onto the rear of the cover sheet 22 and will be visible to a user as, for example, an illuminated area shown as 47 on FIG. 1. Of course, a plurality of different LED lights could be provided. The LED lights could serve as projectors, for example, to project different specific images such as words and the like onto the interior surface of the cover sheet 22 which would be visible through the cover sheet to a person viewing the external surface of the cover sheet. Suitable selection of the flexible material comprising the cover sheet can be made so as to permit light from the FED to be projected onto the interior surface of the cover sheet 22 to be visible to a user.

The reservoir 12 shown in FIGS. 2 and 9 may be rigid reservoirs which do not collapse while fluid is dispensed or may comprise collapsible reservoirs. In the context of the reservoir 12 in FIG. 2, on the collapse of the reservoir 12 as fluid is dispensed by the pump, preferably, the reservoir 12 collapses to a collapsed shape in which it does not contact or deform the cover sheet 22 and thus lets the dispenser assume the external appearance of the dispenser 10 as seen in FIG. 1. With, an oversized dispenser as illustrated in FIG. 10, with collapse of the bottle, the bottle preferably will collapse to reduce in dimension front to back and, in so doing, the protuberant portion 40 will come to be withdrawn rearwardly to a point where the dispenser will come to adopt an appearance as in FIG. 1.

Figure 11:
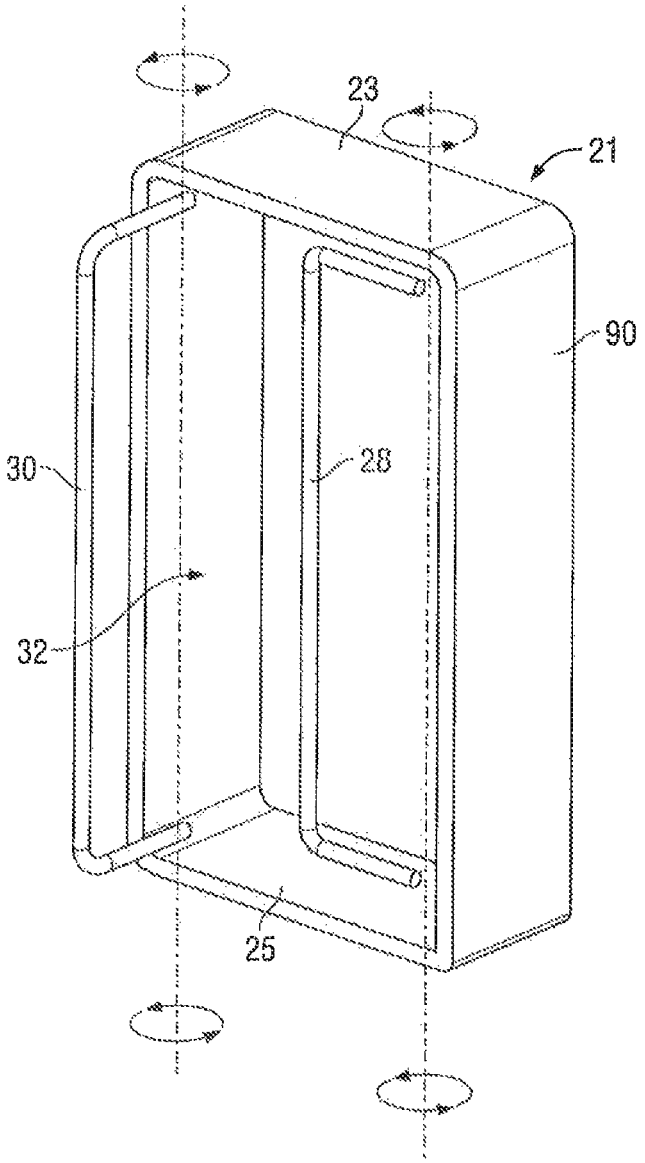
FIG. 11 is a schematic pictorial view illustrating a second embodiment of a frame for a shroud in which each of the metal frame members as schematically illustrated to be pivotally mounted to the frame for pivoting about an axis.

Reference is made to FIG. 11 schematically illustrating an alternative configuration for the shroud 20 which has merely a left side wire frame member 28 and a right side wire frame member 30 which are secured to the shroud frame 21. The distal ends of each of the wire frames 28 and 30 are schematically illustrated as pivotally mounted to each of the top frame member 23 and the bottom frame member 25. Each of the wire frame members 28 and 30 may be pivoted relative to the frame member 21 to a closed position in which they are within the confines of the frame member 90 as can be advantageous for shipment. In the embodiment of FIG. 11, the window 32 is provided between the wire frame members 28 and 29. This window 32 opens not only forwardly but also upwardly and rearwardly. With a shroud frame 21 as shown in FIG. 11, an oversized bottle may extend upwardly as well as forwardly. In the embodiment of FIG. 11, the relative size of the reservoir 12 to be disposed between the wire frames 28 and 30 can determine the extent to which the wire frames 28 and 30 are pivoted about the vertical axis from the closed position to an open position. Different reservoirs can be provided of different shapes and different, for example, widths or front to rear dimensions which will engage the wire frame members 28 and 30, preferably, symmetrically such that the interaction between the reservoir and wire frame members 28 and 30 determine the interior volume of the shroud cover 20. The inherent tendency of the cover sheet 22 to contract when stretched about the frame 21 will tend to urge each of the wire frames 28 and 30 inwardly into the reservoir.

Figure 12:
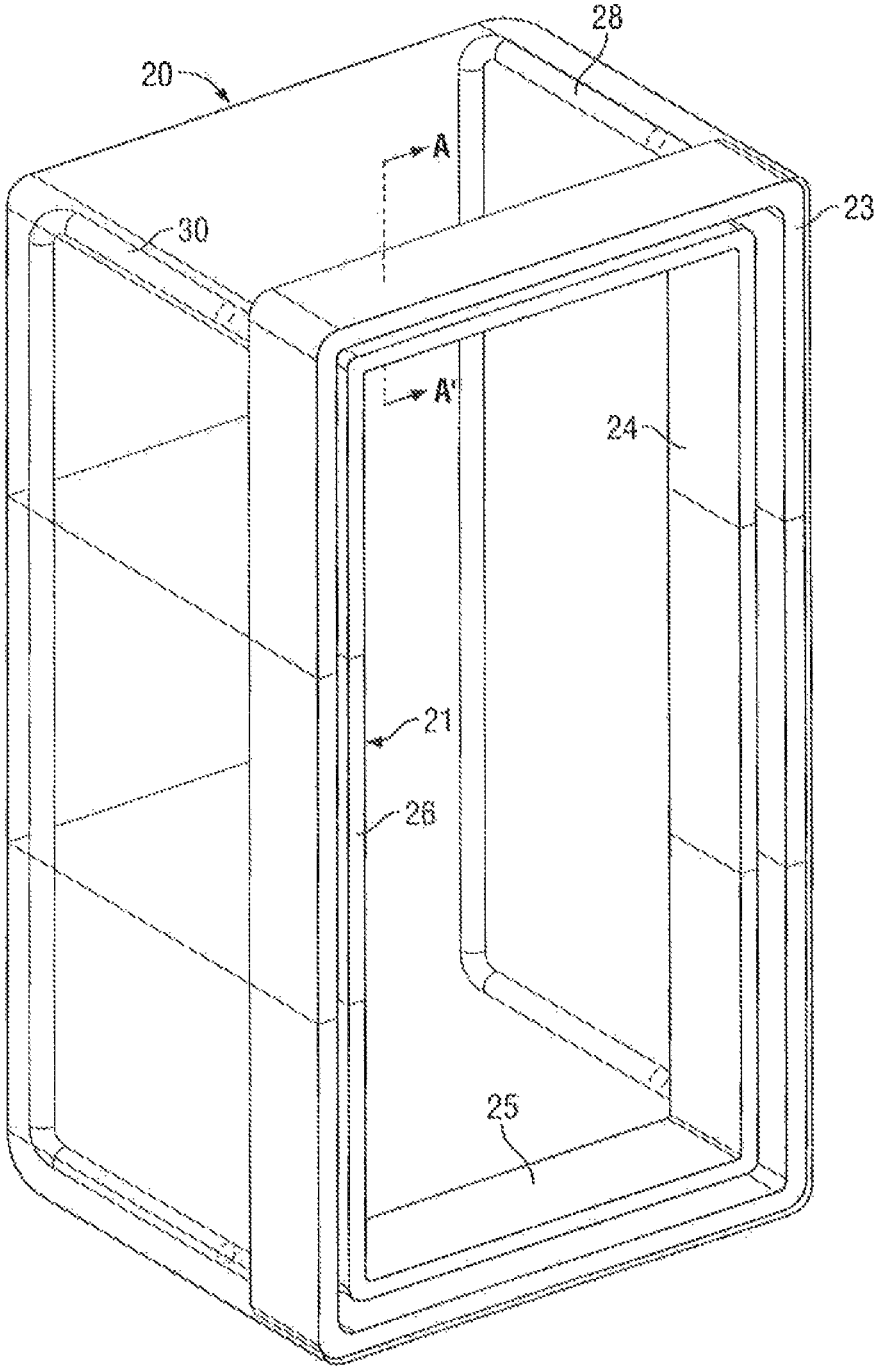
FIG. 12 is a schematic pictorial rear view of a third embodiment of a shroud in accordance with the present invention snowing a frame with a rearwardly directed groove for securing of the cover sheet to the frames.
Figure 13:
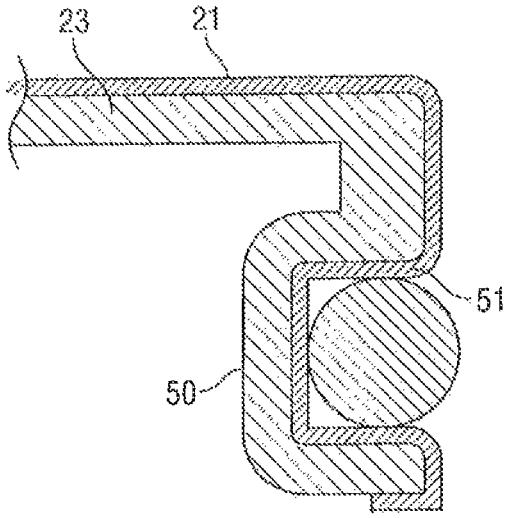
FIG. 13 is a schematic cross-sectional view along section line A-A' in FIG. 12 illustrating one manner of securing the cover sheet to the shroud frame.

Reference is made to FIGS. 12 and 13 which show a third embodiment of a shroud 20 in accordance with the present invention. As seen in FIG. 12, the shroud frame 21 includes the frame members 23, 24, 25 and 26 and a left side wire frame member 28 and a right side wire frame member 30 somewhat similar to that illustrated in FIG. 11. FIG. 12 schematically illustrates the cover sheet 22 as stretched over the shroud frame 21. As seen in FIG. 13 which is a cross-sectional side view along section line A-A' in FIG. 12, the top frame 23 carries an inwardly extending flange 50 with a rearwardly extending groove 51 formed therein. The cover sheet 22 extends into and through the groove 51 and is secured in place by a resilient rod of elastomeric material 52 received in friction-fit within the groove 51 and retaining the cover sheet therein in friction-fit against removal.

Figure 14:
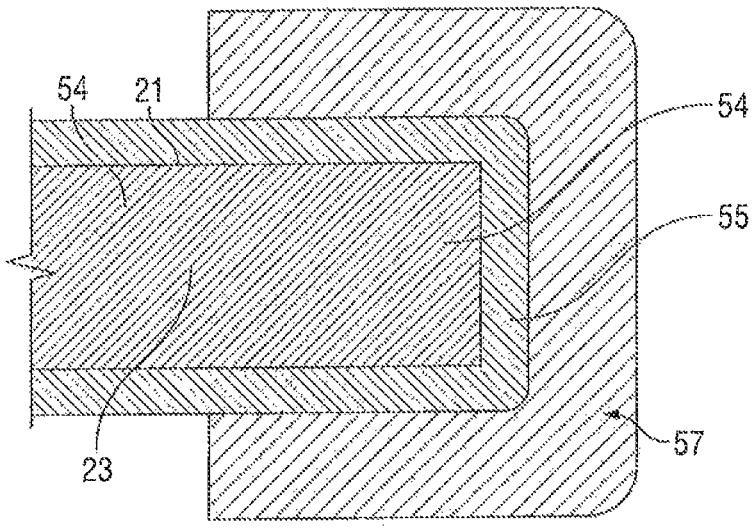
FIG. 14 is a cross-sectional view similar to FIG. 13 illustrating another manner of seeming the cover sheet to a frame with a U-shaped clip.

Reference is made to FIG. 14 which schematically illustrates a cross-sectional view similar to that shown in FIG. 13 of an arrangement in which the top frame 23 has a distal rear end 54 with the sheet member 21 to extend about the distal end 54 and a snap-fit U-shaped clip member 57 to receive the distal end 54 and the cover sheet 22 within a groove 55 formed therein in a friction-fit relation. The clip member 57 may be individual clip members spaced about the frame members 23, 24, 25 and 26 or may be an elongate clip which may, for example, extend along any frame member or substantially about the circumference of the frame 21.

Figure 15:
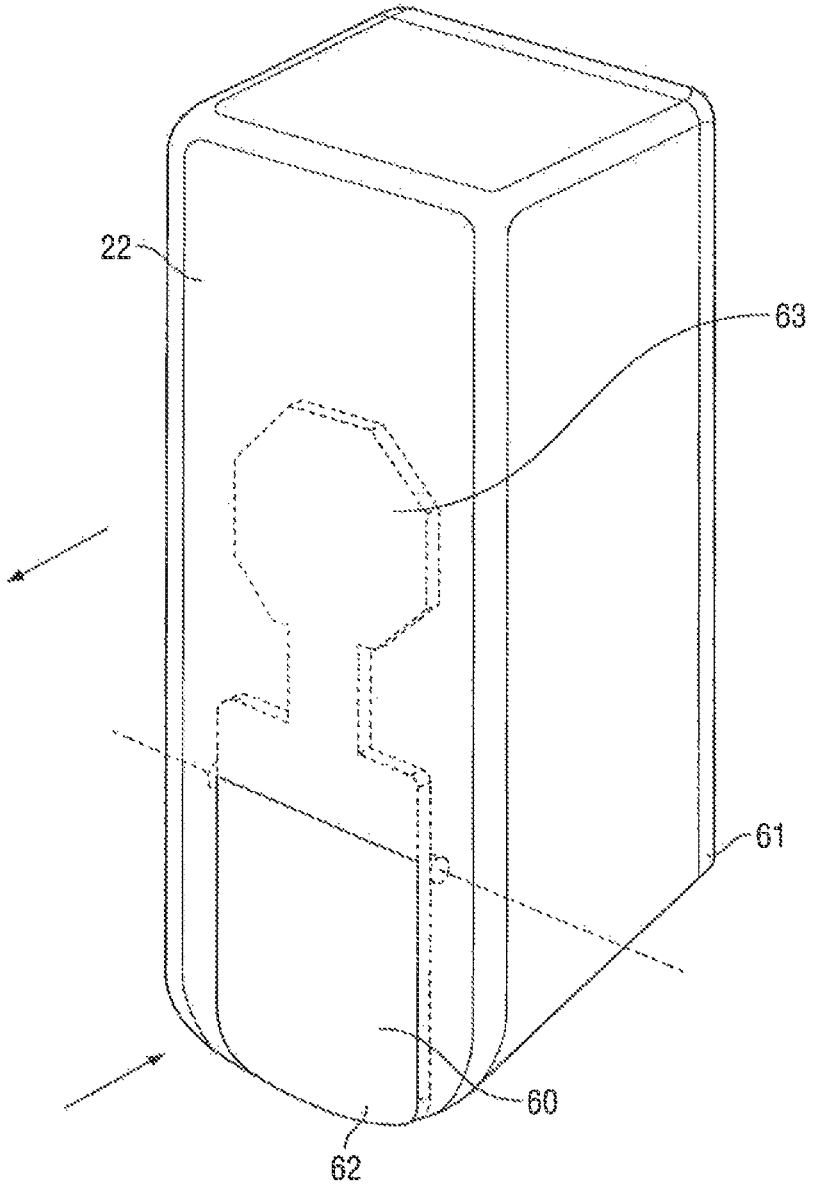
FIG. 15 is a schematic pictorial view of a dispenser in accordance with a fourth embodiment of the invention in which the dispenser carries an activation lever pivotally mounted to the dispenser within the shroud cover with the activation lever in an inactivated rest position.
Figure 16:
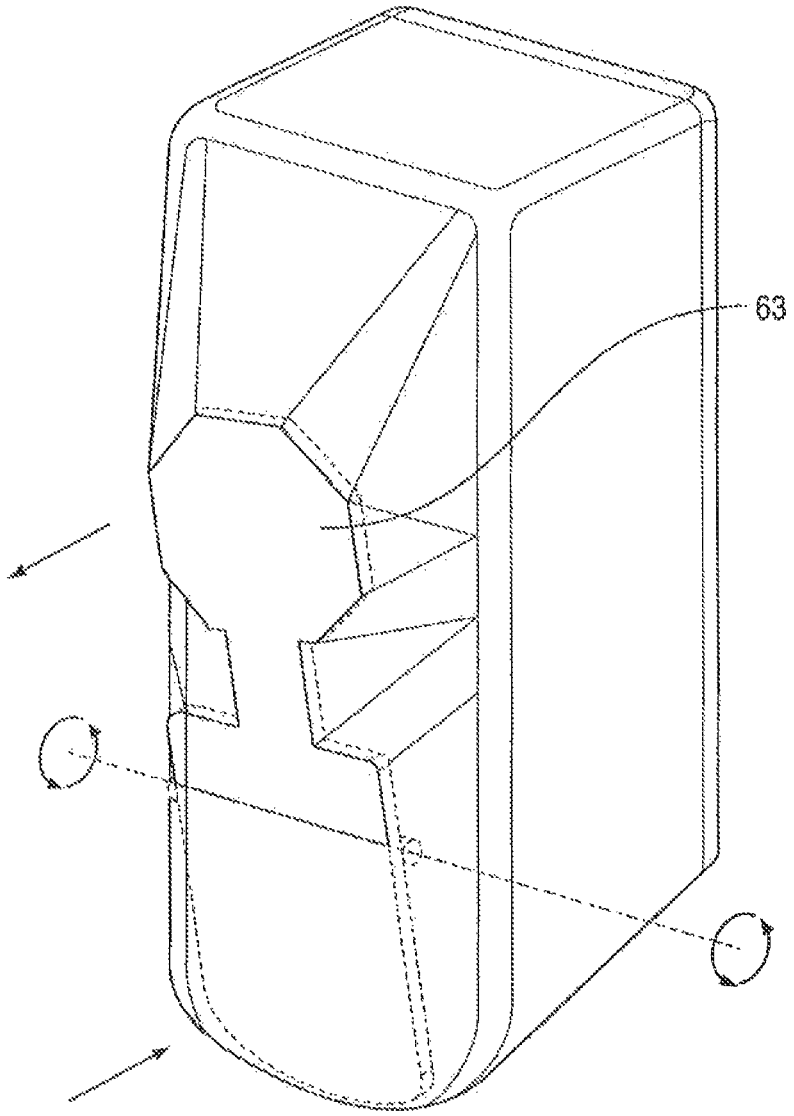
FIG. 16 is pictorial view of the dispenser of FIG. 15 showing the lever when moved to a activated position.

Reference is made to FIGS. 15 and 16 which are schematic pictorial views of the dispenser in accordance with a fourth embodiment of the invention. In FIGS. 15 and 16, an actuation lever 60 is shown as mounted to the dispenser housing for pivoting about a horizontal axis 61. In operation, a user would manually move the lower end 62 of the activation lever rearwardly to operate the pump and dispense fluid downwardly from the bottom of the dispenser. FIG. 15 illustrates the dispenser in a rest position. In the rest position of FIG. 15, to dispense fluid, the lever is pivoted about its axis 61 from the rest position shown in FIG. 15 to an activated position shown in FIG. 16. Typically, a spring will bias the lever 60 to return from the activated position of FIG. 16 to the rest position of FIG. 15. The lever 60 has an upper end 63 shown to have an octagonal profile. On movement of the lever 60 to the activation position, the upper end 63 of the lever is moved forwardly.

The dispenser of FIGS. 15 and 16, similar to the dispenser in the first embodiment, includes a flexible fabric cover sheet 22 stretched over a framework. In the rest position of FIG. 15, the flexible fabric cover sheet 22 is stretched to form the entire exterior of the dispenser and provide an opening at the bottom of the dispenser through which fluid may be dispensed. In the rest position as shown in FIG. 15, the lower portion 62 of the lever 60 may preferably extend marginally forwardly through the cover sheet 22 to be visually apparent to a user, however, the upper end 63 preferably is rearwardly of the cover sheet 22 and not visible to a user. In the activation position shown in FIG. 16, the upper end 63 of the lever is moved forwardly into the cover sheet 22 and deforms the cover sheet 22 forwardly such that the upper end of the lever 60 deforms the cover sheet 22 forwardly and in so doing presents to the user the outline of the octagonal upper portion 63. The octagonal portion 63 may carry various indicia which will carry a message to a user which will be visually apparent as it deforms the cover sheet 22. For example, the octagonal shape of the upper portion 63 may signify that user may stop pushing the lever. The upper portion 63 may carry various surface details such as a company logo and the like which may become apparent on the exterior.

The particular manner in which the lever 60 is mounted to the dispenser for pivoting about its axis 61 is not limited and may be by mounting the lever as to the housing or possibly to a rigid portion of the shroud frame 21.

In the embodiment of FIGS. 15 and 16, with the lever 60 and particularly the lower portion 62 of the lever 60 being internally within the cover sheet 22, various gaps between the lever 60 and support portions for the lever are covered which can avoid pinch points and provide a pleasing appearance.

Figure 17:
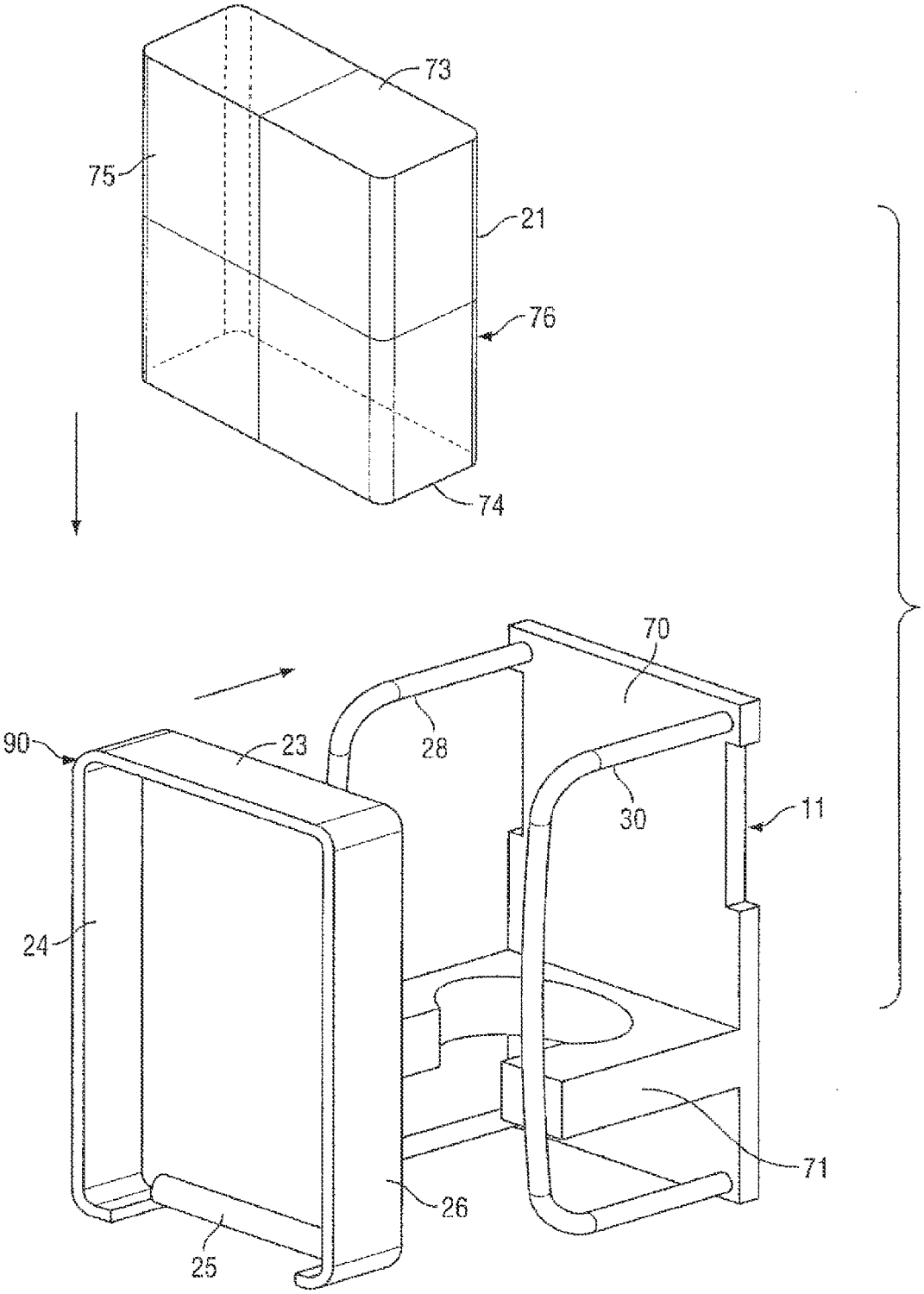
FIG. 17 is a schematic pictorial view illustrating a fifth embodiment of a shroud in accordance with the present invention.

Reference is made to FIG. 17 which illustrates a fifth embodiment of a shroud in accordance with the present invention. FIG. 17 schematically illustrates a dispenser housing 11 including a backplate 70 with a forwardly extending horizontal shelf 71 adapted to support, for example, a reservoir carrying a piston pump to dispense fluid downwardly. A left wire frame member 28 and a right wire frame member 30 are shown as fixedly secured to the housing 11 to extend forwardly along the sides of the housing 11. A peripheral shroud frame member 90 is provided having frame members comprising top left side, bottom and right side frame members 23, 24, 25 and 26.

The cover sheet 22 is in the form of a hollow tubular member of a generally rectangular cross-sectional shape with a horizontal closed upper end 73 and a horizontal open lower end 74. In assembly, the frame member 90 is placed inside the tubular cover sheet 22 with the open end 74 of the tubular cover sheet 22 proximate the bottom frame 25 and with a front 75 of the cover sheet 22 disposed in front of the frame member 90 and a rear 76 of the cover sheet 22 disposed to the rear of the frame member 90. Subsequently, frame member 90 as covered by the cover sheet 22 is urged rearwardly onto the housing 11 with each of the wire frame members 28 and 30 to extend forwardly in between the right side frame member 26 and the left side frame member 24 stretching the cover sheet 22 forwardly through the frame member 90. In the resultant shroud, both the front 74 and the rear 76 of the cover sheet will be adjacent each other and stretched across the front with the wire frame members 28 and 30 protruding forwardly from the frame member 90.

Figure 18:
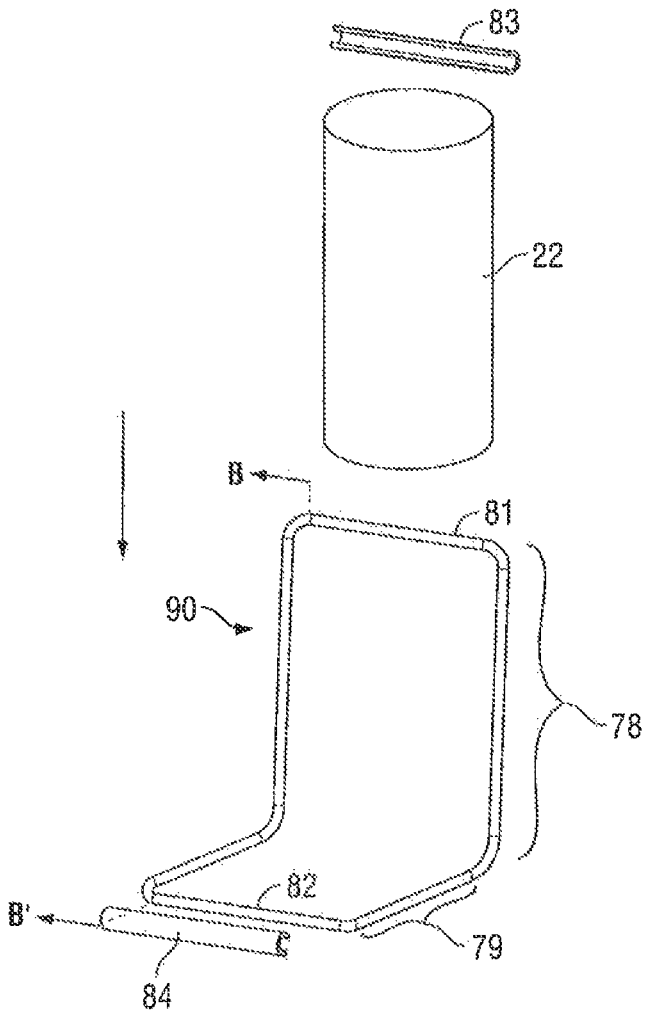
FIG. 18 shows a schematic pictorial view of an alternate shroud frame and cover sheet for use with the fifth embodiment of FIG. 17.
Figure 19:
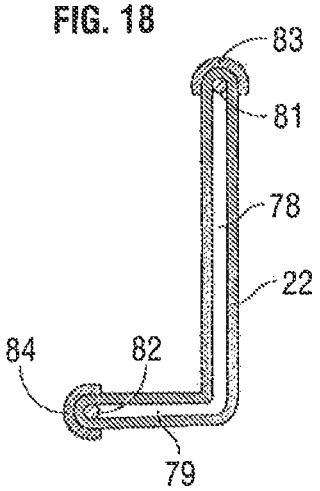
FIG. 19 is a cross-sectional side view of the assembled frame and cover sheet of FIG. 18 along section line B-B'.

Reference is made to FIG. 18 which schematically illustrates an alternate embodiment of a frame shroud cover sheet 22 for use with the embodiment of FIG. 17 in substitution of that shown in FIG. 17. In FIG. 18, the frame member 90 comprises a metal wire frame with a first U-shaped upper portion 78 disposed vertically and opening into a second lower U-shaped portion extending forwardly therefrom. As seen in FIG. 19, the cover sheet 22 is a hollow tubular member with open ends adapted to receive the wire frame member 90 therein. FIG. 19 illustrates a vertical cross-sectional side view of the frame member 90 engaged within the tubular cover sheet 22. The open ends of the tubular cover sheet 22 are shown as closed and secured to the end wires 81 and 82 by resilient metal clip members 83 and 84, which snap over the end wires pinching the cover sheet 22 to the end wires. Alternatively, the open ends could be closed as by sewing, adhesive or the like. Subsequently, as is the case with FIG. 17, the assembly of FIG. 19 may be moved rearwardly onto the housing 11 with the wire frame members 28 and 30 to protrude through the interior of the frame member 90 and with the horizontal lower portion 79 providing a downwardly extending opening via which fluid may be dispensed.

In the embodiment of, for example, FIGS. 17 to 19, the tubular cover sheet 22 may be relatively inexpensive and readily replaced by other cover sheets, for example, after each use or if the cover sheet may become contaminated. As well, cover sheet 22 may be provided with various readily customized graphics on its forwardly directed surface 75 permitting easy customization.

Figure 4:
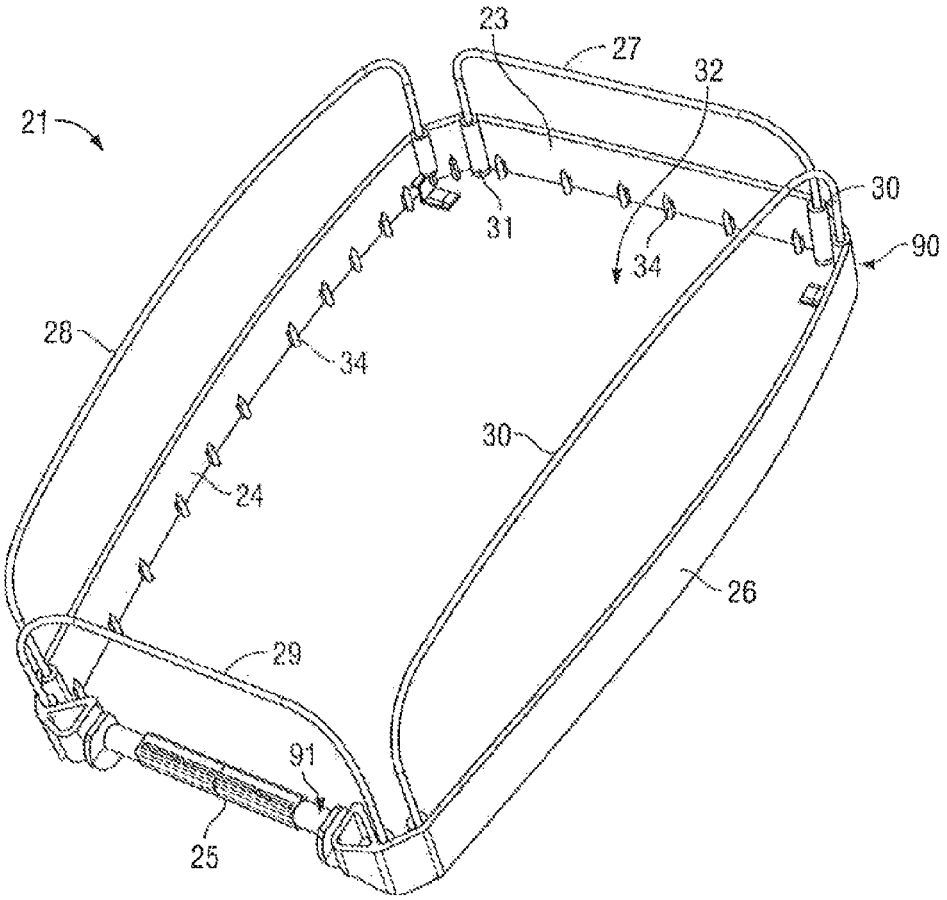
FIG. 4 is a bottom front perspective view of the shroud of FIG. 1 with its cover sheet removed to show the shroud frame.
Figure 20:
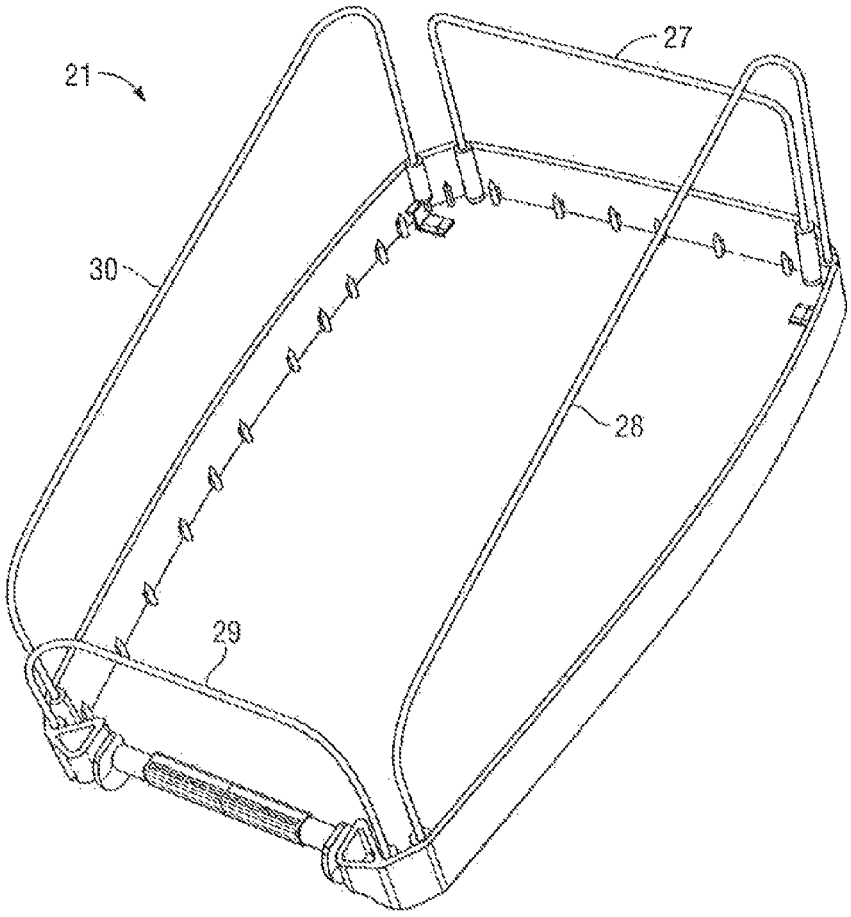
FIG. 20 is a view similar to FIG. 4 of a shroud cover in accordance a sixth embodiment of the present invention.

In accordance with the present invention, the external appearance of the dispenser may be readily customized. For example, in respect of a dispenser as shown in FIG. 1 formed from a shroud frame 21 as seen in FIG. 4, a very different appearance may be provided to the dispenser merely by modifying the wire frame members 27, 28, 29 and 30 as, for example, to adopt the modified wire frame members as shown in FIG. 20.

Figure 21:
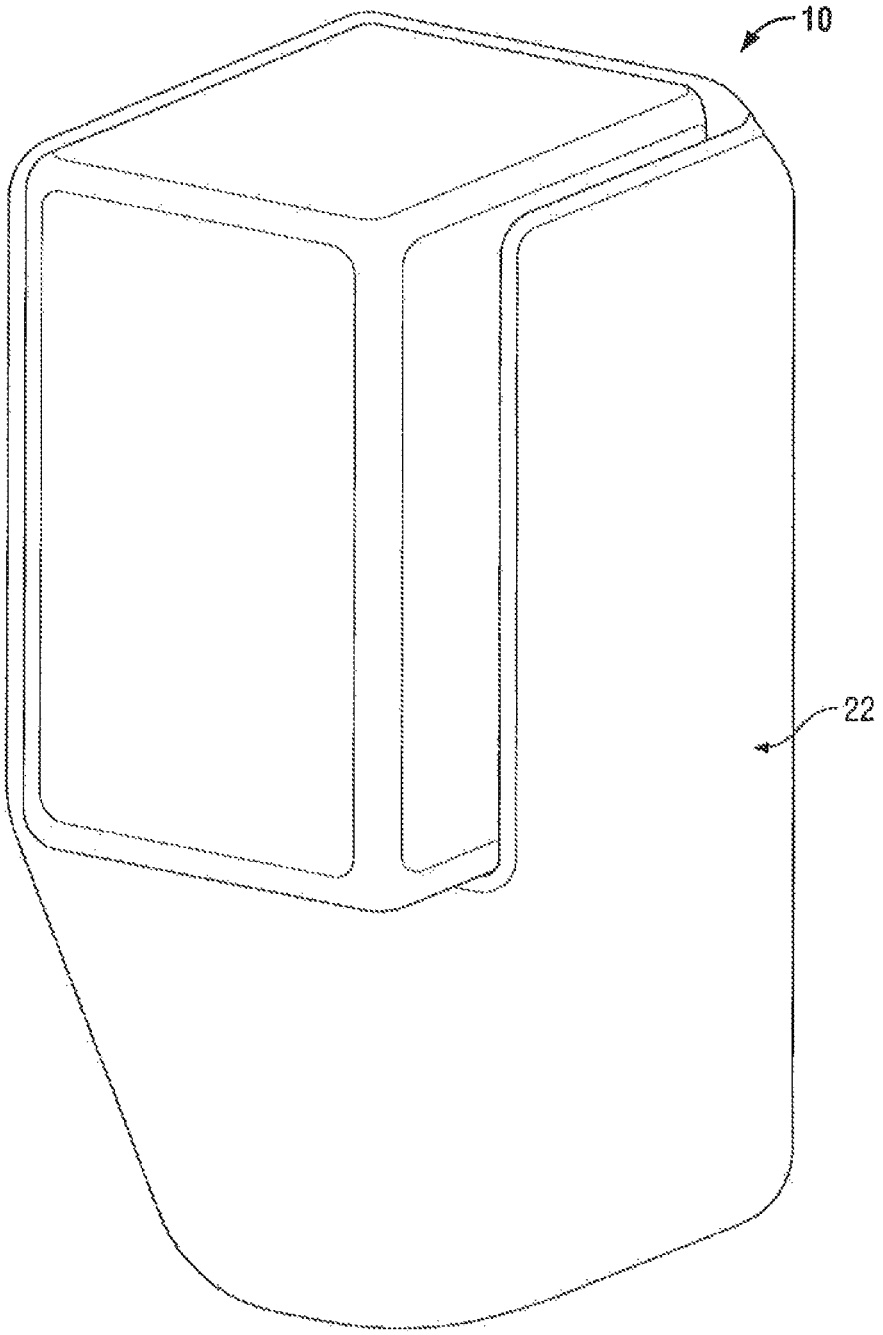
FIG. 21 is a schematic pictorial view of a dispenser similar to that shown in FIGS. 1 and 10, however, with the cover sheet deformed to extend both forwardly and upwardly by a reservoir bottle.

Reference is made to FIG. 21 which illustrates a dispenser 10 in accordance with the present invention such as in FIG. 17 in which the protuberant portions of a reservoir are schematically illustrated as extending both forwardly and upwardly beyond a window in the shroud frame and with a schematic shroud cover 22 shown as covering the entirety of the dispenser 10 and being deformed both forwardly and upwardly relative to the underlying frame members.

Figure 22:
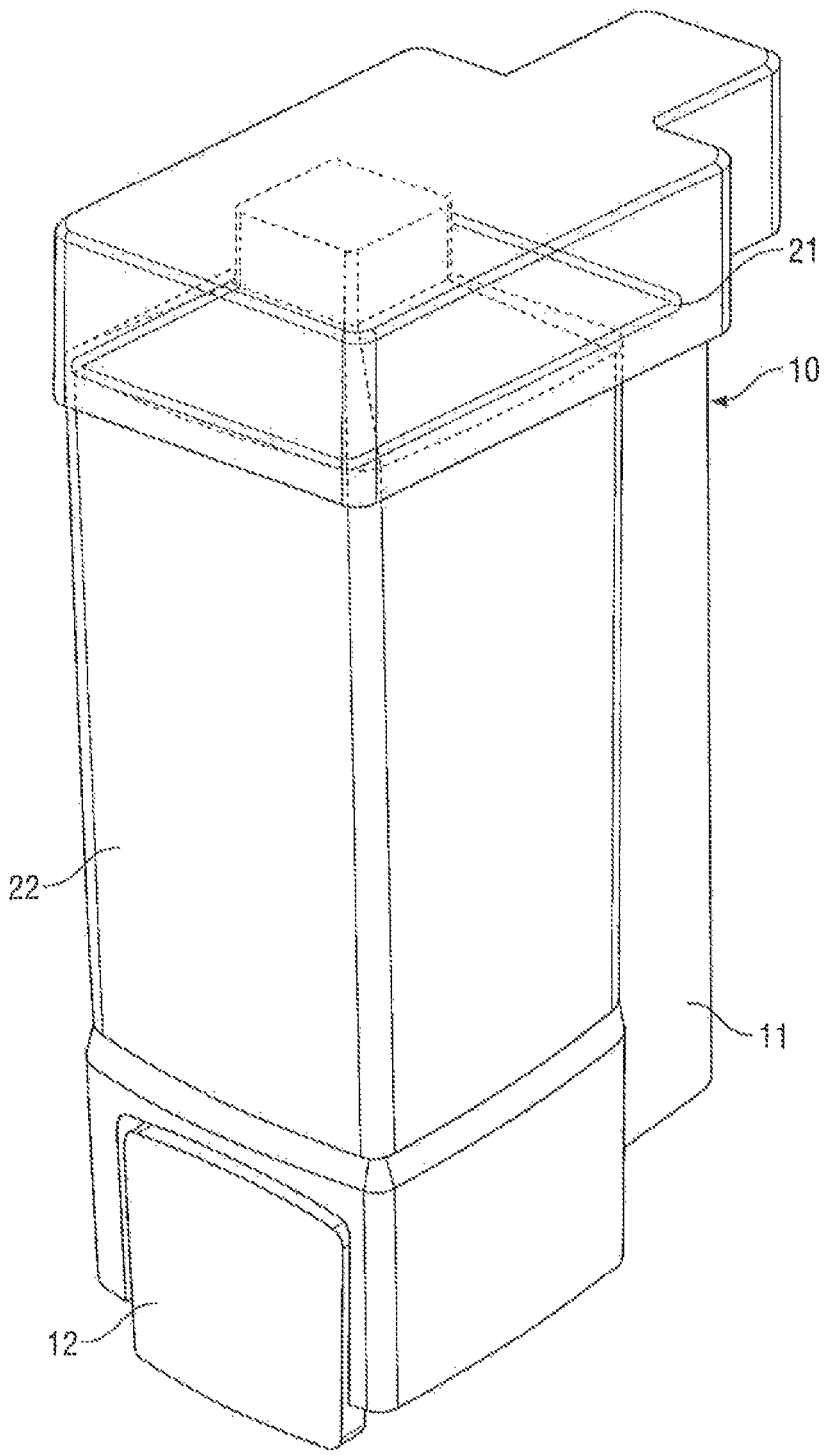
FIG. 22 which shows a pictorial view of a dispenser in accordance with a seventh embodiment of the present invention ready for use, that is, fully assembled.
Figure 23:
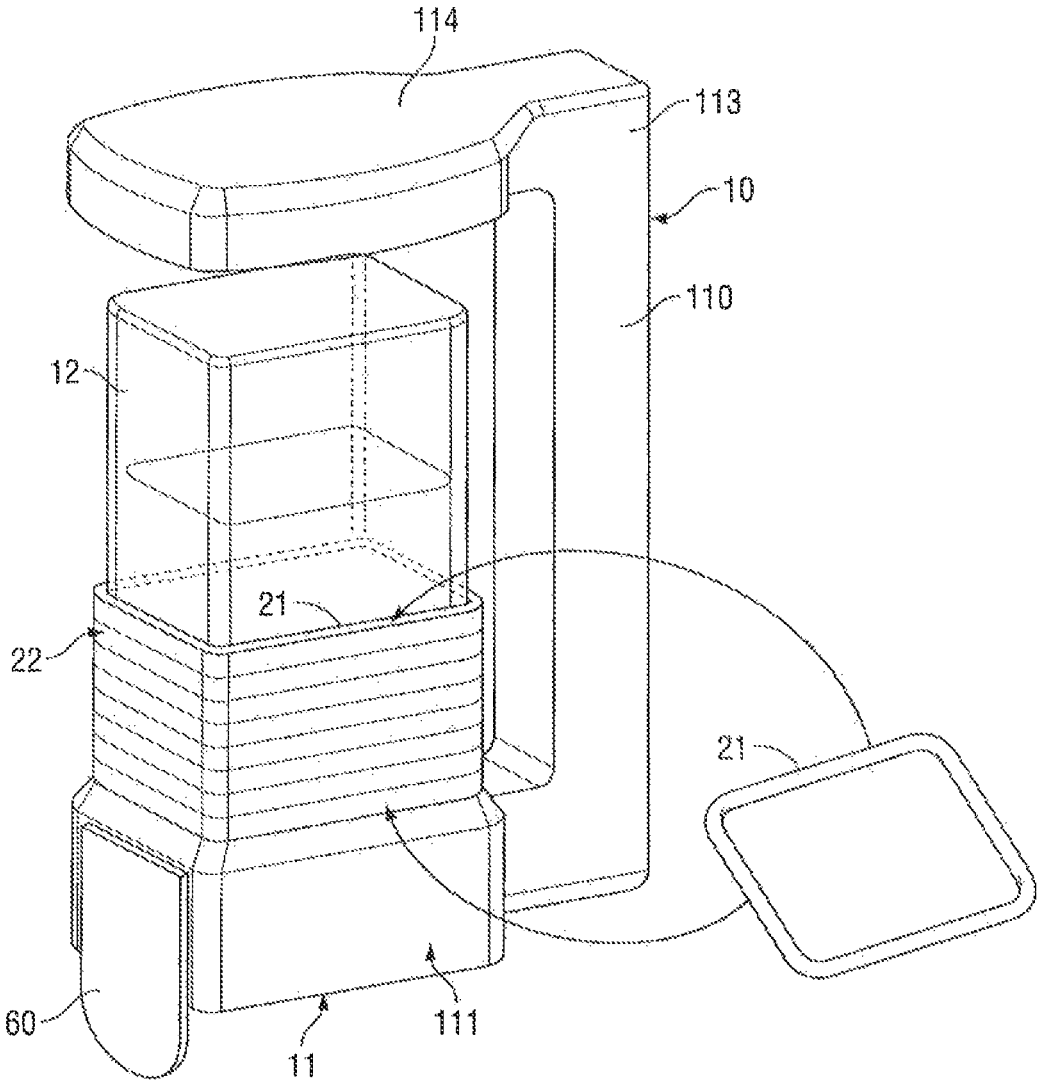
FIG. 23 is a partially disassembled view of the dispenser of FIG. 22.

Reference is made to FIGS. 22 and 23 which show another embodiment of the dispenser in accordance with the present invention. As seen in FIG. 23, the dispenser has a housing 11 with a vertical rear post 110 adapted to be secured as to a wall or the like. At the lower end of the post, a support member 111 is provided which will support the reservoir 12 and serve to couple the reservoir to a pump via which fluid can be dispensed from the reservoir downwardly via the pump as by a user manually engaging the activation lever 60. The post 110 carries at its upper end 113 a forwardly extending top cap 114. The reservoir 12 is preferably removable from the dispenser or alternately may be permanent and adapted to be refilled from its top. The cover sheet 22 comprises an elongate tube which is open at both ends. A lower open end of the tubular sheet 22 is secured to the support member 111 with a frame member 21 engaged internally within the tube 22 which frame member 21 has a rectangular profile and which frame member 21 is adapted to be received in snap-fit to the support member holding the bottle about the bottle 12. A similar rectangular ring serves as a frame member 21 within the upper open end of the tube 22 which rectangular ring frame member 21 is adapted to be urged upwardly into the underside of the top cap 114 into a snap-fit relation. The upper rectangular ring frame member 21 is schematically illustrated in FIG. 23. The snap rings 21 at either end of the tube 22 preferably are provided a distance apart such that the tube 22 is tensioned between its ends. The tensioning can be provided merely by snap-fitting the rings 21 in place or a spring arrangement can be provided if the post 110 is expandable as with a spring biasing the top cap upwardly, in the context of the sheet cover 22 in FIGS. 22 and 23, the cover sheet 22 need not be elastic. For example, it could comprise a relatively rigid sheet of polyethylene plastic which may deform and permit some stretching but need return to its original shape. The tube 22 preferably is of constant internal circumferential extent about an axis and each of the ring frame members 21 to be received at each end of the tube is preferably of an external circumferential extent at least as great as the circumferential extent of the tube and preferably of the same circumferential extent. The reservoir received inside the tube may be collapsible or not collapsible. Arrangements could be made to have the post 110 extendable to different lengths to thus locate the ring end frame members 21 at different distances apart and a suitable locking mechanism to lock the post 110 at different lengths. Thus, by selecting the post 110 to have different lengths, different reservoirs of different axial extent may be accommodated.

Insofar as the tube may be elastic, then the arrangement illustrated in FIGS. 22 and 23 may also accommodate reservoirs of different circumferential extent and shape.

Figure 24:
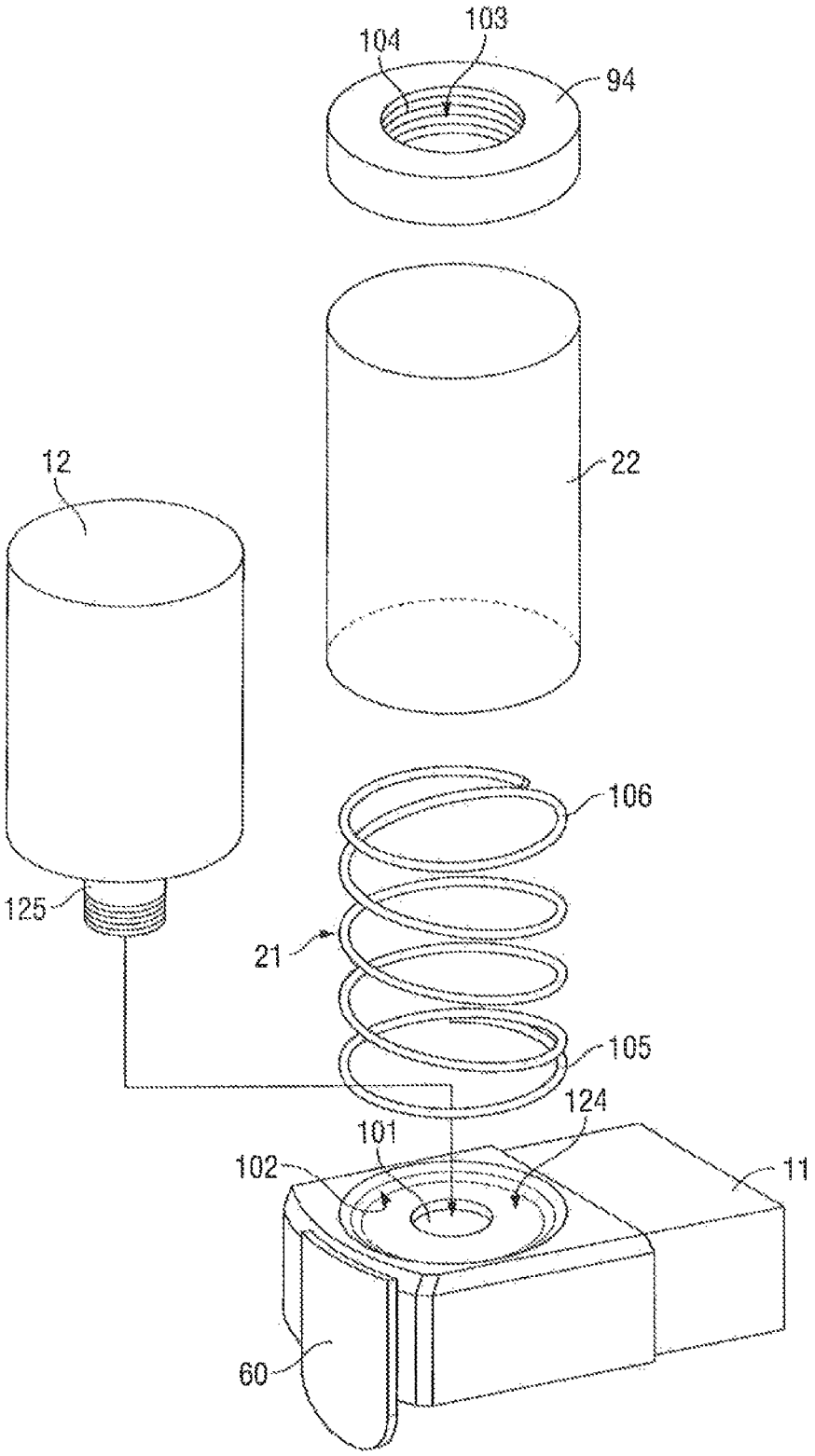
FIG. 24 is a schematic pictorial exploded view of a dispenser in accordance with an eighth embodiment of the present invention.

Reference is made to FIG. 24 which illustrates a soap dispenser 10 having a housing 11 adapted to be mounted to a wall and carrying therein a pump mechanism, not shown, and a manually operated actuator 60 to activate the pump to dispense fluid from the reservoir 12. The housing 11 carries an upwardly directed socket central opening 101 to which the threaded neck 125 of the reservoir 12 is adapted to be received in sealed threadable engagement. About this opening 101, there is disposed an annular socket 124 with a side wall having an annular groove 102 therein extending radially outwardly into the side wall. As a frame member helical coil spring 21 is provided which has an upper circular frame ring 106 at one end and a lower circular frame ring 105 at the other end and is connected by helical coils. A cylindrical tube 22 forms the shroud cover adapted to be disposed about the helical coil spring 21 with the lower frame ring 105 inside a lower end of the tube 22 and with the lower end of the tube to be engaged in friction snap-fit in the annular groove 102 between the frame ring 105 of the coil and the socket 124. The upper end of the tube 22 is adapted to have the upper circular frame ring 106 of the helical coil spring 21 received therein. A circular cap 94 is provided having a socket provided therein similar to that in the housing 11 with an internal annular groove 104. The upper end of the tube 22 is to be received in a friction-fit within the cap 94 between the annular groove 104 and the cap and the upper frame ring 106 of the frame 21. In assembly, the bottle 12 may be secured to the housing 11. Next, the tube 22 is disposed about the helical spring 21 and the lower end 105 of the helical spring is forced into the socket 124 securing the lower end of the time about the lower frame ring 105 in the socket. Subsequently, the upper end of the tube is drawn upwardly through a central opening 103 in the cap 94 at the same time the cap 94 is urged downwardly to compress the helical spring 21 until the inside of the cap 94 engages the top of the bottle 12. At that point, the cap 94 is snap-fitted onto the upper ring frame 106 of the helical spring snap-fitting the upper end of the tube therein. The tube 22 is thus tensioned axially by the compressed helical coil.

While the invention has been described with reference to preferred embodiments, many modifications and variations will now occur to persons skilled in the art. For a definition of the invention, reference is made to the following claims.

We claim:

1. A fluid dispenser comprising:

a reservoir for fluid, a cover shroud at least partially enclosing the reservoir, the shroud having a resiliently deformable portion having an inherent bias to assume an unbiased condition in which the shroud enclosed a first volume, the deformable portion being deformable from the unbiased condition to a biased condition in which the shroud encloses a second volume different than the first volume.

2. A fluid dispenser as claimed in claim 1 wherein the deformable portion comprises an elastomeric material.

3. A fluid dispenser as claimed in claim 1 including a shroud window through the shroud having a window perimeter, the deformable portion comprising a sheet member spanning across the window from the perimeter in the unbiased condition and the biased condition.

4. A fluid dispenser as claimed in claim 3 wherein the reservoir includes a protuberant portion which extends from within the shroud through the window and deforms the deformable portion outwardly through the window from the unbiased condition to the biased condition.

5. A fluid dispenser as claimed in claim 3 wherein the reservoir is collapsible and collapses from an initial enlarged configuration of an initial volume to a collapsed condition of a collapsed volume less than the initial volume, when the reservoir is in the enlarged configuration the reservoir includes a protuberant portion which extends from within the shroud through the window and deforms the deformable portion outwardly through the window from the unbiased condition to the biased condition, with the collapse of the reservoir as fluid is dispensed from the reservoir, the protuberant portion withdrawals through the window to within the shroud and the deformable portion deforms from the biased condition to the unbiased condition.

6. A fluid dispenser as claimed in claim 3 including a protuberant portion which extends from within the shroud through the window and deforms the deformable portion outwardly through the window from the unbiased condition to the biased condition.

7. A fluid dispenser as claimed in claim 6 wherein the protuberant portion is mounted to the dispenser for movement between an extended position and a retracted position, in the extended position the protuberant portion extends from within the shroud through the window and deforms the deformable portion outwardly through the window from the unbiased condition to the biased condition, in the retracted position, the protuberant portion does not extend from within the shroud through the window, in movement from the extended position to the retracted position, the protuberant portion withdrawals through the window to within the shroud and the deformable portion deforms from the biased condition to the unbiased condition.

8. A fluid dispenser as claimed in claim 7 wherein movement of the protuberant portion between the extended position and the retracted position is controlled as a function of the operation of the dispenser in dispensing fluid.

9. A fluid dispenser as claimed in claim 8 wherein:

the dispenser includes an actuator which moves to dispense fluid from the reservoir, on moving the actuator to dispense fluid, the protuberant portion is moved between the extended position and the retracted position.

10. A fluid dispenser as claimed in claim 8 wherein:

the dispenser is a manually operated dispenser, the dispenser includes an actuator movement by a user to dispense fluid from the reservoir, moving the actuator to dispense fluid moves the protuberant portion between the extended position and the retracted position.

11. A fluid dispenser as claimed in claim 1 further comprising:

a housing carrying the reservoir, the cover shroud mounted to the housing, the cover shroud comprising a shroud frame and a flexible cover sheet;

the shroud frame defining an open framework of interconnected frame members of a three-dimensional shape defining therebetween an internal cavity within the frame and openings into the cavity between adjacent of the frame members, the cover sheet stretched over the frame members to span the openings, the cover shroud at least partially enclosing the reservoir with at least portions of the reservoir within the internal cavity.

12. A shroud for a fluid dispenser comprising:

a hollow tube of flexible sheet material extending along a central axis from a first end to a second end, the tube having a first internal circumferential extent at the first end and a second internal circumferential extent at the second end, a framework including a first frame end and a second frame end spaced from the first frame end, the first frame end having a first external circumferential extent at least as large as the first internal circumferential extent of the tube, the second frame end having a second external circumferential extent at least as large as the second internal circumferential extent of the tube, the tube disposed over the framework with the first end of the tube received about the first end frame and the second end of the tube received about the second end frame.

13. A shroud as claimed in claim 12, wherein the tube is tensioned axially between the first frame end and the second frame end enclosing an open interior cavity therein.

14. A dispenser including a shroud as claimed in claim 12 including a fluid reservoir within the interior cavity.

15. A fluid dispenser comprising:

a housing carrying a reservoir containing a fluid to be dispensed, a cover shroud mounted to the housing, the cover shroud comprising a shroud frame and a flexible cover sheet;

the shroud frame defining an open framework of interconnected frame members of a three-dimensional shape defining therebetween an internal cavity within the frame and openings into the cavity between adjacent of the frame members, the cover sheet stretched over the frame members to span the openings, the cover shroud at least partially enclosing the reservoir with at least portions of the reservoir within the internal cavity.

16. A fluid dispenser as claimed in claim 15 wherein one of the openings through the cover shroud comprises a shroud window having a window perimeter, the dispenser carries a protuberant portion which extends from within the shroud through the window, the cover sheet including a cover portion spanning across the window from the window perimeter overlying the protuberant portion.

17. A fluid dispenser as claimed in claim 16 wherein the reservoir includes the protuberant portion.

18. A fluid dispenser as claimed in claim 16 wherein the protuberant portion is mounted to the dispenser for movement between an extended position and a retracted position, in the extended position, the protuberant portion extends from within the shroud through the window and deforms the cover portion outwardly through the window, in the retracted position, the protuberant portion does not extend from within the shroud through the window, in movement from the extended position to the retracted position, the protuberant portion withdraws through the window to within the shroud, the cover portion being resiliently deformable between conditions including:

(a) a first condition in which the protuberant portion is in the retracted position and the deformable portion is tensioned across the window perimeter and the shroud encloses a first volume; and (b) a second condition in which the protuberant portion is in the extended position protruding outwardly from the cavity through the window deforming the cover portion outwardly such that the shroud encloses a second volume greater than the first volume, the cover portion being resiliently deformable having an inherent bias biasing the deformable portion from the second condition to the first condition.

19. A fluid dispenser as claimed in claim 18 wherein the reservoir includes the protuberant portion, the reservoir is collapsible and collapses from an initial enlarged configuration of an initial volume to a collapsed condition of a collapsed volume less than the initial volume, when the reservoir is in the enlarged configuration, the protuberant portion is in the extended position with the collapse of the reservoir as fluid is dispensed from the reservoir, the protuberant portion withdraws through the window to the retracted position within the shroud and the cover portion deforms from the second condition to the first condition.

20. A fluid dispenser as claimed in claim 18 wherein:

the dispenser includes an actuator which moves to dispense the fluid from the reservoir, on moving the actuator to dispense fluid, the protuberant portion is moved between the extended position and the retracted position.

21. A fluid dispenser as claimed in claim 15, the shroud comprising:

a hollow tube of flexible sheet material extending along a central axis from a first end to a second end, the tube having a first internal circumferential extent at the first end and a second internal circumferential extent at the second end, a framework including a first frame end and a second frame end spaced from the first frame end, the first frame end having a first external circumferential extent at least as large as the first internal circumferential extent of the tube, the second frame end having a second external circumferential extent at least as large as the second internal circumferential extent of the tube, the tube disposed over the framework with the first end of the tube received about the first end frame and the second end of the tube received about the second end frame.

22. A dispenser as claimed in claim 15 wherein the cover shroud enclosing the reservoir between the cover and the housing.

23. A dispenser as claimed in claim 15 wherein the cover shroud is mounted to the housing for moving between a closed position and an open position, in the closed position, the cover shroud at least partially encloses the reservoir and, in the open position, the reservoir is accessible for removal and replacement or for refilling.

24. A dispenser as claimed in claim 23 wherein the cover shroud is pivotally mounted to the housing for moving between the closed position and the open position.

25. A dispenser as claimed in claim 15 wherein the cover sheet being resilient deformable having an inherent bias to assume an unbiased condition and being deformable from the unbiased condition to biased conditions in which the inherent bias urges the cover sheet toward the unbiased condition, the cover sheet when stretched over the frame members to span the openings is in one of the unbiased positions in which the inherent bias tensions the cover sheet across each of the openings.

26. A fluid dispenser as claimed in claim 25 wherein the cover sheet comprises a resiliently stretchable flexible material.

27. A dispenser as claimed in claim 15 wherein the framework comprises a rigid peripheral frame and at a plurality of U-shaped frame members, each U-shaped frame member having a first arm and a second arm joined by a bight, each of the first arm and the second arm having a distal end remote from the bight, the distal end of the first arm and the distal end of the second arm of each U-shaped frame member is coupled to the peripheral frame at circumferentially spaced locations, each U-shaped frame member is coupled to the peripheral frame at circumferentially spaced locations from other of the U-shaped frame members.

28. A dispenser as claimed in claim 15 wherein:

the framework comprises a rigid peripheral frame and a first U-shaped frame member, the first U-shaped frame member having a first arm and a second arm joined by a bight, each of the first arm and the second arm of the first U-shaped frame member having a distal end remote from the bight, the first U-shaped frame member coupled to the peripheral frame member with the distal end of the first arm and the distal end of the second arm of the first U-shaped frame member coupled to the peripheral frame at peripherally spaced locations and the first arm and second arm of the first U-shaped frame extending forwardly to locate the bight of the first U-shaped frame forwardly of the peripheral frame, a first of the openings defined within the first arm, the bight, and the second arm of the first U-shaped frame member and a portion of the peripheral frame bridged by the first U-shaped member between the first arm and the second arm of the first U-shaped frame.

29. A dispenser as claimed in claim 28 wherein:

the framework comprises a second U-shaped frame member, the second U-shaped frame member having a first arm and a second arm joined by a bight, each of the first arm and the second arm of the second U-shaped frame member having a distal end remote from the bight, the second U-shaped frame member coupled to the peripheral frame member with the distal end of the first arm and the distal end of the second arm of the second U-shaped frame member coupled to the peripheral frame at peripherally spaced locations and the first arm and second arm of the second U-shaped frame extending forwardly to locate the bight of the second U-shaped frame forwardly of the peripheral frame, a second of the openings defined within the first arm, the bight, and the second arm of the second U-shaped frame member and a portion of the peripheral frame bridged by the second U-shaped member between the first arm and the second arm of the first U-shaped frame, the second U-shaped frame member coupled to the peripheral frame at circumferentially spaced locations from the first U-shaped frame member.

30. A dispenser as claimed in claim 29 wherein the second U-shaped frame member is coupled to the peripheral frame with at least portions of the second U-shaped member spaced from and opposed to at least portions of the first U-shaped member such that a third of the openings spans between the first U-shaped frame member and the second U-shaped frame member.

31. A dispenser as claimed in claim 30 wherein the second U-shaped frame member coupled to the peripheral frame at a location diametrically opposed to a location of the first U-shaped frame member on the peripheral frame.

32. A dispenser as claimed in claim 31 wherein the third of the openings is defined at least in part between the bight of the first U-shaped frame member and the bight of the second U-shaped frame member.

* * * * *